US006123408A

United States Patent [19]

Ishize et al.

[11] Patent Number: 6,123,408

[45] Date of Patent: Sep. 26, 2000

[54] INK-JET TYPE IMAGE FORMING APPARATUS AND AN INK SUCTION PUMP USED THEREIN

[75] Inventors: Tatsuhiro Ishize; Takashi Suzuki; Takaaki Sekiyama, all of Ebina, Japan

[73] Assignee: Fuji Xerox Co., Ltd., Tokyo, Japan

[21] Appl. No.: 08/900,332

[22] Filed: Jul. 25, 1997

[30] Foreign Application Priority Data

| | | | |
|---|---|---|---|
| Jul. 30, 1996 | [JP] | Japan | 8-200362 |
| Aug. 6, 1996 | [JP] | Japan | 8-206886 |
| Aug. 29, 1996 | [JP] | Japan | 8-228131 |
| Dec. 6, 1996 | [JP] | Japan | 8-327246 |
| Dec. 20, 1996 | [JP] | Japan | 8-341889 |

[51] Int. Cl.[7] ..... B41J 2/165; F04B 39/10

[52] U.S. Cl. ..... 347/30; 347/29; 417/545

[58] Field of Search ..... 347/30, 24, 29, 347/32; 417/545, 550, 547

[56] References Cited

U.S. PATENT DOCUMENTS

| | | | |
|---|---|---|---|
| 4,315,582 | 2/1982 | Micallef | 222/148 |
| 4,695,851 | 9/1987 | Terasawa | 347/30 |
| 5,115,250 | 5/1992 | Harmon et al. | 347/33 |
| 5,504,508 | 4/1996 | Hashimoto | 347/24 |
| 5,543,826 | 8/1996 | Kuronuma et al. | 347/23 |
| 5,701,146 | 12/1997 | Akiyama et al. | 347/26 |
| 5,805,180 | 8/1998 | Ebisawa et al. | 347/23 |
| 5,883,645 | 3/1999 | Ikado et al. | 347/30 |

FOREIGN PATENT DOCUMENTS

| | | | |
|---|---|---|---|
| 5-169680 | 7/1993 | Japan | B41J 2/18 |

*Primary Examiner*—N. Le
*Assistant Examiner*—Shih-Wen Hsieh
*Attorney, Agent, or Firm*—Oliff & Berridge, PLC

[57] ABSTRACT

An ink-jet image forming apparatus is formed from a plurality of nozzles which eject ink corresponding to image information, a plurality of cap members which cover the nozzles and an ink suction pump that is connected to the cap member which suctions ink in the cap member. The pump is formed by a cylinder formed from an interior space and two ink suction ports that go through to the interior space and a piston arranged as movable in this interior space. Each ink suction port is connected to a different cap member and the piston is moved between the two ink suction ports.

18 Claims, 23 Drawing Sheets

RELATIONSHIP BETWEEN PISTON PACKING HARDNESS AND REQUIRED PRESSURE (VACUUM)

RELATIONSHIP BETWEEN PISTON PACKING HARDNESS AND REQUIRED SEALAGE

INK-JET TYPE IMAGE FORMING APPARATUS AND AN INK SUCTION PUMP USED THEREIN

BACKGROUND OF THE INVENTION

1. Field of the Invention

This invention relates to an image forming apparatus and relates specifically to an ink-jet type image forming apparatus and an ink suction pump used therein, in which an image is formed by ejecting ink to a recording medium such as paper.

2. Description of Related Art

Conventionally, an ink-jet type image forming apparatus has, for example, a recording medium transfer member that transfers paper and the like in a specified transfer direction and a recording head carriage arranged opposite a transfer path of the recording medium. The carriage is movable in a direction perpendicular to the transfer direction of the recording medium and ejects ink from the nozzles towards the transfer path of the recording medium.

Moreover, a full color, ink-jet type image apparatus uses a recording head carriage capable of ejecting yellow ink, magenta ink, cyan ink and black ink. Further, the full color, ink-jet type image forming apparatus generally comprises a plurality of recording heads composed of a nozzle component provided for each color, respectively, and an ink tank. Moreover, each of the nozzle components has a plurality of nozzles formed therein and each of the ink tanks is designed to be attachable and detachable from the recording head carriage.

The ink-jet type image forming apparatus carries the recording medium using the recording medium transfer member. A prescribed image is formed on the recording medium by ejecting ink in accordance with image information while the recording medium is being transferred and the recording head carriage is being moved back-and-forth across the transfer path.

However, this type of ink-jet type image forming apparatus has various problems in maintaining image quality. Poor image quality is associated with the ink itself as well as its ejection from the nozzles to form the image.

Specifically, first, the ink dries out in the nozzle components, particularly when no images are being formed. When this condition occurs, the viscosity of the ink increases and, thus, the way the ink ejects from the nozzle components changes so that the desired image is not easily formed.

Second, when foreign material or air enters the nozzles, the ink does not eject properly. Also, when the drying of the ink has progressed, the ink does not eject properly.

Third, it is not possible to properly form the image because of unstable ink ejection caused by the surface of the ink drying directly after beginning image formation.

Fourth, the ink tank may become separated from the recording head and be replaced making it necessary to refill the interior of the nozzle component with ink after replacement.

In the conventional ink-jet type image forming apparatus described above, when images were not properly formed, a plurality of cap members were provided which covered each nozzle component to prevent drying of ink. A plurality of ink suction pumps were also provided for suctioning the ink from each cap member.

However, in the conventional ink-jet type image forming apparatus, it is not possible to miniaturize the apparatus because of the space required in order to have the same number of ink suction pumps as the number of recording heads.

A design for miniaturizing the apparatus was drawn up which reduced space by connecting a plurality of cap members to one ink suction pump. This caused a surplus of space, whereby the area for suction in the one ink suction pump was too large for ink ejection, making the suction operation time consuming because of inefficient suction. This resulted in a waste of ink in the ink suction operation and, in extreme cases, tacky ink became clogged in the nozzle component and could not be suctioned out.

In a conventional apparatus: (1) drying of the ink an be prevented by covering each nozzle with its corresponding cap member; (2) by suctioning the ink when each nozzle is covered by its corresponding cap member, tacky ink or the like can be removed from the nozzles; (3) by ejecting ink from each nozzle directly before image formation begins, ejection blurring of the ink, which occurs at the beginning of image formation, can be prevented. Hereafter, the first will be called the capping action, the second will be called the recovery action, and the third will be called the dummy jet action.

Additionally, among conventional ink-jet type image forming apparatus, there are apparatus that are provided with a recovery cap that can carry out the recovery action as well as cover each nozzle when image formation is not taking place. There are also apparatus provided with storage cap members which only cover each nozzle when image formation is not taking place.

By covering the nozzles with the above-described cap members, drying of the ink can be prevented. By covering the nozzles with the above-described recovery cap member, tacky ink or the like can be removed from the nozzles. Furthermore, by ejecting ink from the nozzles to the recovery cap members directly before image formation begins, ejection blurring that normally occurs at the beginning of image formation can be prevented.

However, in the former conventional image forming apparatus, when tacky ink is removed from a desired nozzle, ink is wasted because ink is suctioned from all the nozzles, not just the desired nozzle. Moreover, the size of the waste ink tank that holds the removed ink must be increased.

Meanwhile, in the latter conventional image forming apparatus, when the dummy jet action is carried out, ink must be ejected from each nozzle in sequence into one recovery cap member. This takes an extremely long time.

SUMMARY OF THE INVENTION

Therefore, an object of the present invention is to provide an ink-jet type image forming apparatus and an ink suction pump used in conjunction with the ink-jet type image forming apparatus capable of effectively suctioning ink and small in size.

The present invention is an ink-jet type image forming apparatus, comprising a recording head having a plurality of nozzle components for ejecting ink in accordance with image information, a plurality of cap members for covering the nozzle components, and an ink suction pump connected to the cap members. The ink suction pump suctions ink held in the cap members. The ink suction pump includes a cylinder having an interior space and two ink suction ports passing through the interior space and a piston arranged such that it is movable in the interior space. Each of the ink suction ports is connected to different cap members and ink in the cap member is suctioned by moving the piston in the cylinder.

Another object of the invention is to provide an ink suction pump having a cylinder comprising an interior space and two ink suction ports that go through to this interior space, and a piston arranged so that it is freely movable within the interior space. The ink suction pump is built for the ink-jet type image forming apparatus to suction ink within the cap member by moving the piston within the cylinder. By this technique, it is possible to remove the ink from the nozzle twice as quickly because the ink can be removed while the piston moves back and forth.

The nozzle component ejects ink and generally includes a plurality of nozzles. A plurality of nozzles may be arranged so as to eject ink of separate colors in each prescribed group, or to eject ink of one type of color.

A cap member can cover the nozzle component. For example, not only is an indentation formed in the surface (referred to below as the front surface) opposing the nozzle part; it is also possible to have a composition in which there is a rubber cap in which a through-hole is formed pierced from the indentation to the side surface, an ink maintaining member such as a sponge arranged within the indentation, and a cap case in which the cap is accommodated. In this configuration, there is no leakage of ink from the nozzle component and ink is not drawn into the nozzle component, because the pressure between the ink tank and pressure in the indentation when the nozzle part is being covered or for the interval in which the nozzle part remains covered is in equilibrium because outside air passes into the indentation through the through-hole.

The word "covered" does not mean only that the periphery of the nozzle component is completely covered by the cap member, but it also means that the nozzle component is covered to the extent necessary to a degree to properly prevent drying of ink in the nozzle component.

Further, in the ink-jet type image forming apparatus that has a plurality of nozzle components, the plurality of nozzle components may be covered by one cap member or each nozzle component may be covered by a cap member.

Another object of the invention is to provide an ink-jet type image forming apparatus where two ink suction ports may be provided in one ink suction pump, and each ink suction port is connected to a cap member, significantly reducing the space required in the ink suction pump.

Another object of the invention is to provide an ink-jet type image forming apparatus where ink is suctioned from each ink suction port interchangeably because the ink suction pump comprises a cylinder having an interior space and two ink suction ports going through to this interior space, and each ink suction port is connected to a different cap member so that ink in the cap member is suctioned by moving the piston in the cylinder.

Another object of the invention, besides providing an ink expulsion port between the two ink suction ports of the cylinder, is to provide an ink expulsion path that passes through each ink suction chamber formed on both sides of the piston and the ink suction ports to the piston. By doing this, it is possible to expel ink from each ink suction chamber to one of the expulsion ports.

It is possible to eject ink smoothly while suppressing ink backflow by arranging the ink expulsion port at the bottom part of the interior space of the cylinder and by making the area of the ink expulsion port larger than the area of each ink suction port.

One of the apertures may be sealed corresponding to the direction of motion of the piston rod when an ink expulsion path is provided that passes through each ink suction chamber formed on both sides of the piston and the ink expulsion port to the piston. An example of this construction comprises a piston head for sliding the piston in the cylinder and a piston rod for supporting the piston head so that it can swing in the direction of motion of the piston. Moreover, not only is the ink expulsion path in this construction formed in the piston head, in which the ink expulsion path passes through each ink suction chamber and ink expulsion port, but also a pair of sealing members are formed on the piston rod for sealing the aperture facing each ink suction chamber of the ink expulsion path.

This construction can include a piston head main body in which a piston head is formed that is somewhat smaller than the interior space of the cylinder, and a pair of piston rings arranged on both side of the ink expulsion path of the piston head main body, the piston rings having roughly a V-shape in cross section, or roughly a Y-shape in cross-section. The pair of piston rings can also be arranged on the piston head main body so that the grooves of each ring mutually face each other. By doing this, it is possible to prevent the flow of ink by reliably interrupting it by the piston rings between each ink suction chamber and ink expulsion port. It is also possible to markedly suppress sliding resistance between the cylinder and the pair of piston rings which occurs when the piston head is moved.

Another object of the invention is to provide piston rings which can be formed by silicon rubber of a hardness that is equal to or greater than 30 Hs. By doing this, it is possible to obtain sufficient pressure when pressure is lowered in each ink suction chamber to suction the ink. It is also possible to suction the ink at a good rate of efficiency.

Another object of the invention is to provide an image forming apparatus, which prevents drying of ink by covering each nozzle part by each cap member, whereby it is possible to remove tacky ink and the like from the nozzle part by suctioning the ink in a state in which the nozzle part is covered by the cap member. Furthermore, it is possible to prevent ejection unevenness of the ink that occurs when beginning image formation by ejecting ink from each nozzle part directly prior to beginning image formation. Below, the first operation is referred to as the capping operation, the middle operation is referred to as the recovery operation, and the last operation is referred to as the dummy jet operation.

Another object of the invention is to provide a pump which suctions foreign material in the nozzle or suctions so as to refill the ink in the nozzle and further suctions the ink remaining in the cap member as a test directly before image formation.

In order to refill the ink or suction of foreign material in the nozzle, the pump may be operated at an extremely high suction pressure against the nozzle. On the other hand, the pump may suction the ink slowly over a long time in order to perform a trial in which it suctions the ink remaining in the cap member.

Accordingly, the suction properties of the ink in these suction operations could not be entirely matched by the pump, and the ink could not be suctioned efficiently.

Further, although the provision of a separate pump for each suction operation was considered in order to eliminate these problems, this increased the space necessary for use of the pump 5.

A further object of the invention is to provide an ink suction pump which may be operated at an extremely high suction pressure against the nozzles in order to refill the ink or suction of foreign material in the nozzles. Alternatively, ink can be suctioned for a long time in order to suction ink remaining in the cap members. Also, in order to achieve the suction pressure described earlier, a composition is acceptable in which, for example, the ink suction port is formed toward the center of the cylinder, and the ink suction port and the cylinder are passed through after the piston has been moved to a certain degree. Or, a composition is acceptable in which the sealing valve is arranged in the ink suction port, and the sealing valve is open after the piston has been moved to a certain degree.

Alternatively, in order to achieve the latter suction pressure, a composition is acceptable, for example, in which the ink suction port is formed toward the end part of the cylinder, so that the ink suction port and the suction chamber in the cylinder are always passed through despite the position of the piston.

Further, in the present invention, it is also possible to make the maximum value of the pressure occurring in each of the suction chambers different when the initial capacity of each suction chamber is different at the time suction is commenced. Also, the initial capacity suction suction chamber at the time suction is commenced may be set as small when, for example, a high suction pressure is to occur.

This invention has a further object to provide an ink-jet type image forming device which can reduce ink waste during recovery action, and which can carry out the dummy jet action in a short period of time.

Another object of the invention is to provide a pumping means connected to the plurality of cap members, which suctions ink or the like independently from each individual cap member. For example, the pumping means may comprise a plurality of pumps equal in number to the plurality of cap members, and a plurality of hoses connecting the pumps and cap members. In this structure, ink or the like can be suctioned independently from each cap member by independently controlling the action of each pump.

Alternatively, the pumping means may comprise a pump connected to a plurality of cap members provided with through holes, and a single through-hole closing member that is positioned facing the through-hole of a single cap member and which can close the through-hole when appropriate. Ink can then be suctioned from all the nozzles through the cap member having the cap through-hole closing member provided therein.

In the ink-jet type image forming apparatus of this invention, a plurality of cap members are provided that cover a plurality of nozzles. Therefore, the plurality of nozzles are covered, and drying of the ink can be prevented.

Additionally, in the aforementioned image forming apparatus, pumping means are connected to the plurality of cap members for suctioning ink or the like away from all of the cap members. Therefore, each nozzle can be made to face a corresponding cap member, and a dummy jet action ("test firing" of the ink) can be carried out. The waste ink can be suctioned away by the pumping means.

Also, in this image forming apparatus, the pumping means can suction ink or the like independently from each individual cap member. Therefore, tacky ink or the like can be suctioned from just a cap member covering a nozzle that has been plugged by the ink or the like. In other words, ink can be suctioned and recovered from just the plugged nozzle, and need not be suctioned from the other nozzles.

Furthermore, in this image forming apparatus, ink can be ejected into all of the cap members, and all the nozzles can be covered in a condition in which ink is held within all of these cap members. Therefore, drying of the ink within the nozzles can be restricted even when the apparatus sits unused for a long period of time.

When the recovery action is carried out in each cap member, the plurality of nozzles are arranged on a single recording head carriage, and the plurality of cap members are arranged on a single cap carriage. Furthermore, a nozzle position determining component is provided at a specified position with respect to the nozzles, and a cap position determining component is similarly provided at a specified position with respect to the cap members. The positions of the cap members and the nozzles can be determined using these position determining components.

When the aforementioned positions are determined, if the cap carriage is arranged so as to be movable in the same direction as the direction of movement of the recording head carriage, the nozzle position determining component can be meshed with the cap position determining component by simply moving the cap carriage via the recording head carriage. This enables a very precise positioning of the cap members with respect to the nozzles.

Alternatively, in the case of carrying out the recovery action through a single cap member, the plurality of nozzles are arranged on a single recording head carriage, and the plurality of cap members are arranged on a single cap carriage. Furthermore, a nozzle position determining component is provided at a specified position with respect to each nozzle, and a cap position determining component is similarly provided at a specified position with respect to each cap member. The positions of the cap members and the nozzles can be determined using these position determining components.

When the aforementioned positions are determined, if the cap carriage is arranged so as to be movable in the same direction as the direction of movement of the recording head carriage, a specified nozzle position determining component can be meshed with a specified cap position determining component by simply moving the cap carriage via the recording head carriage. This enables a very precise positioning of a specified cap member with respect to a specified nozzle.

When these positions are determined, it is preferable to arrange either or both of the recording head carriage and the cap carriage so that they are movable in the contacting/separating direction, thereby making it possible to form a space between the recording head carriage and the cap carriage. By so doing, it becomes possible to smoothly move the recording head carriage when the position is being determined, and there is no friction generated between the recording head carriage and cap carriage.

Additionally, it is preferable to arrange the nozzle position determining component and/or the cap position determining component so as to be flexible in the direction of movement. By so doing, there is no damage even if either of the position determining components accidentally comes into contact with the opposing carriage, which can happen, especially when the electrical power is turned on.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Hereafter, a detailed description of embodiments of the image forming apparatus of this invention is provided, based on the attached drawings.

Figure 1:
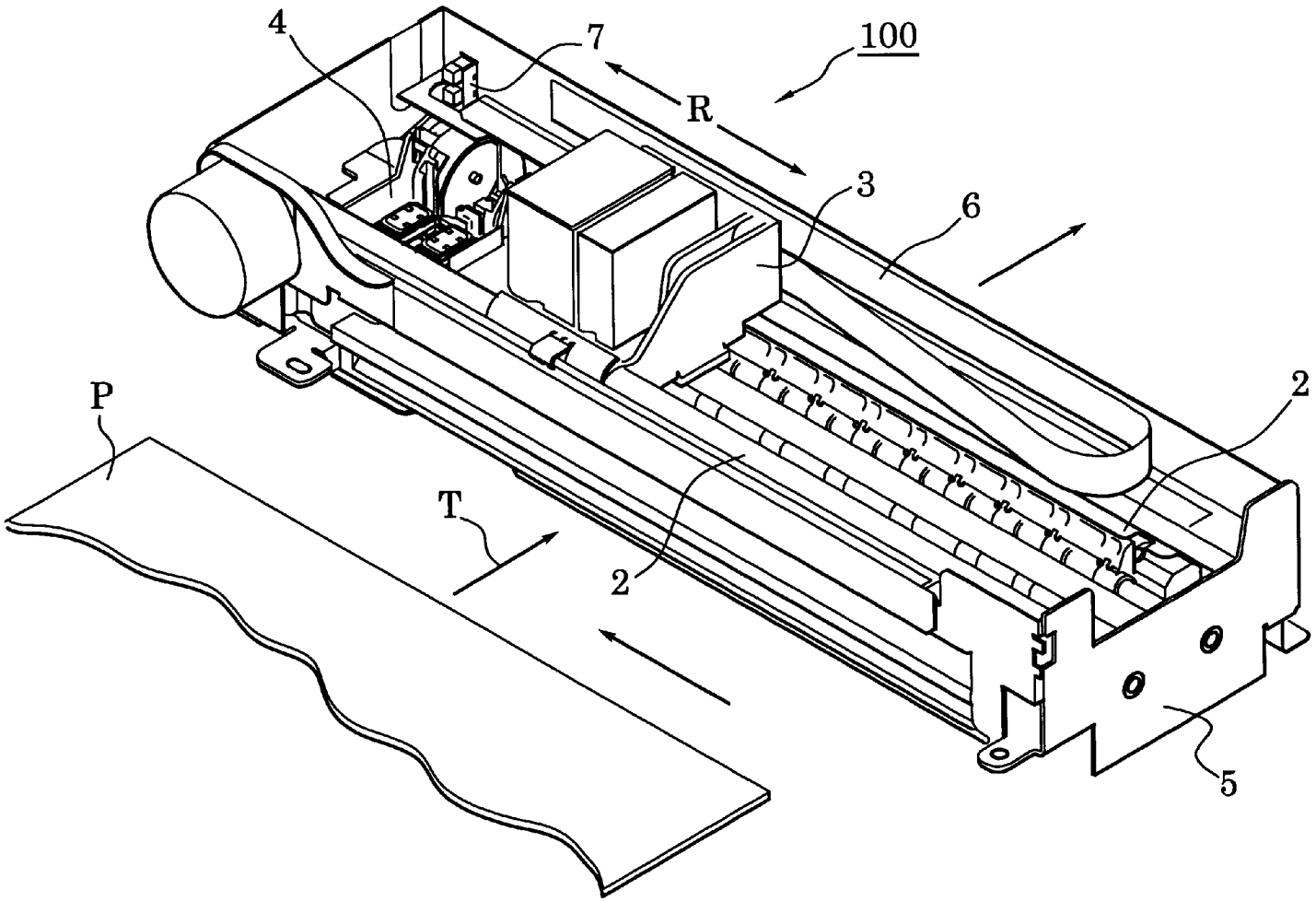
FIG. 1 is a perspective view of the ink-jet type image forming apparatus of a first embodiment of the invention.

An ink-jet type image forming apparatus 100 relating to a first embodiment is shown in FIG. 1.

Figure 2:
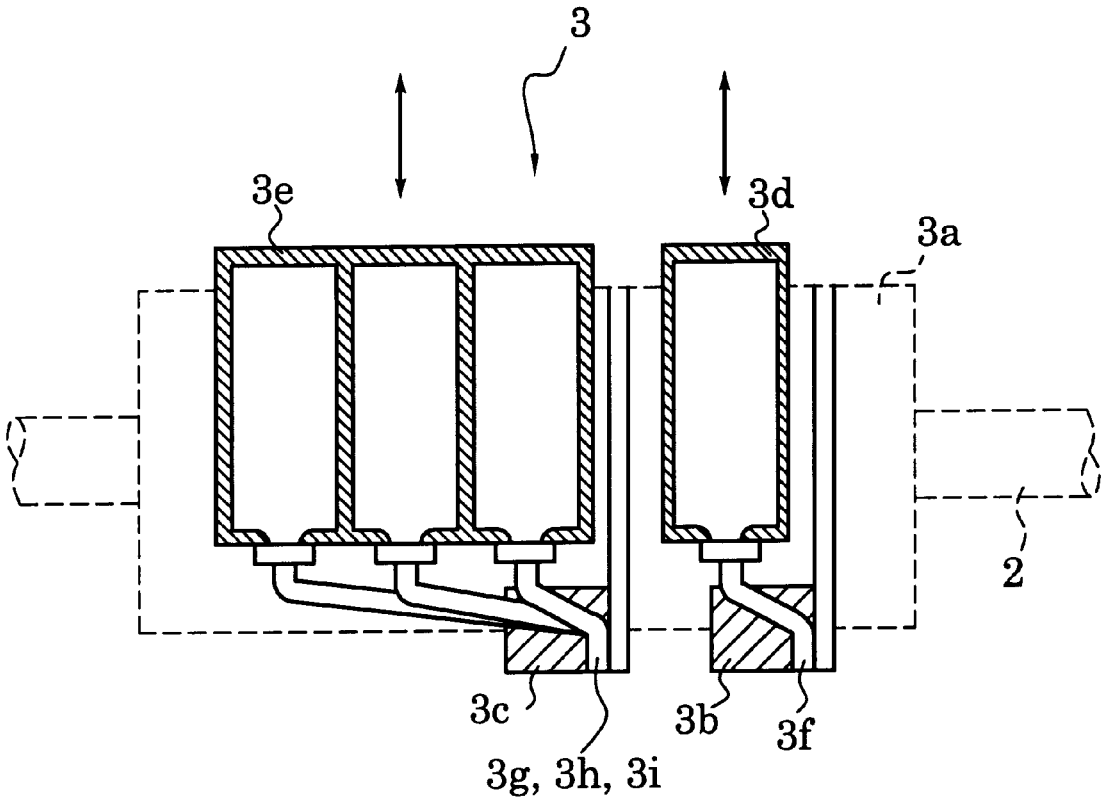
FIG. 2 is a sectional view of a recording head carriage shown in FIG. 1.

This image forming apparatus has a recording medium transfer member 1 that transfers a recording medium P in a specified direction, a pair of a guide members 2 opposite the transfer path of the record medium P and extending in a direction perpendicular to the transfer direction of the recording medium P, a recording head carriage 3 that is supported by the guide member 2, a maintenance station 4 that is arranged under the guide member 2 and close to the recording medium transfer path, and a housing that houses all of the aforementioned elements. Image information is sent to the recording head carriage 3 through a signal line which is formed in a flexible base. A home position of the recording head carriage 3 is detected by a home position sensor 7 that is arranged at a position opposite the maintenance station 4. As shown in FIG. 2, the recording head carriage 3 comprises a head carriage frame 3*a* arranged so as be movable on the pair of guide members 2, two nozzle members 3*b* and 3*c* that are arranged so as to spray ink lower than a bottom surface that faces the recording medium transferring path of the head carriage frame 3*a*, and two ink tanks 3*d* and 3*e* that supply ink to each nozzle member 3*b* and 3*c*, and which are attachable to and detachable from the head carriage frame 3*a*.

Moreover, many nozzles are arranged in each nozzle member 3*b* and 3*c*. In the nozzle member 3*b*, a single color of ink is ejected in response to image information since the ink tank 3*d* which is connected to the nozzle member 3*b* supplies black ink. Meanwhile, in the other nozzle member 3*c*, three colors of ink are able to be ejected in response to the image information, since the ink tank 3*e* that is connected to the nozzle member 3*c* supplies yellow ink, magenta ink and cyan ink. In the drawings of this embodiment, several nozzles for each color described above are shown as one nozzle for convenience and, thus, 3*f* represents a group of several nozzles for black ink, 3*g* represents a group of nozzles for yellow, 3*h* represents several nozzles for magenta and 3*i* represents a group of several nozzles for cyan.

Figure 3:
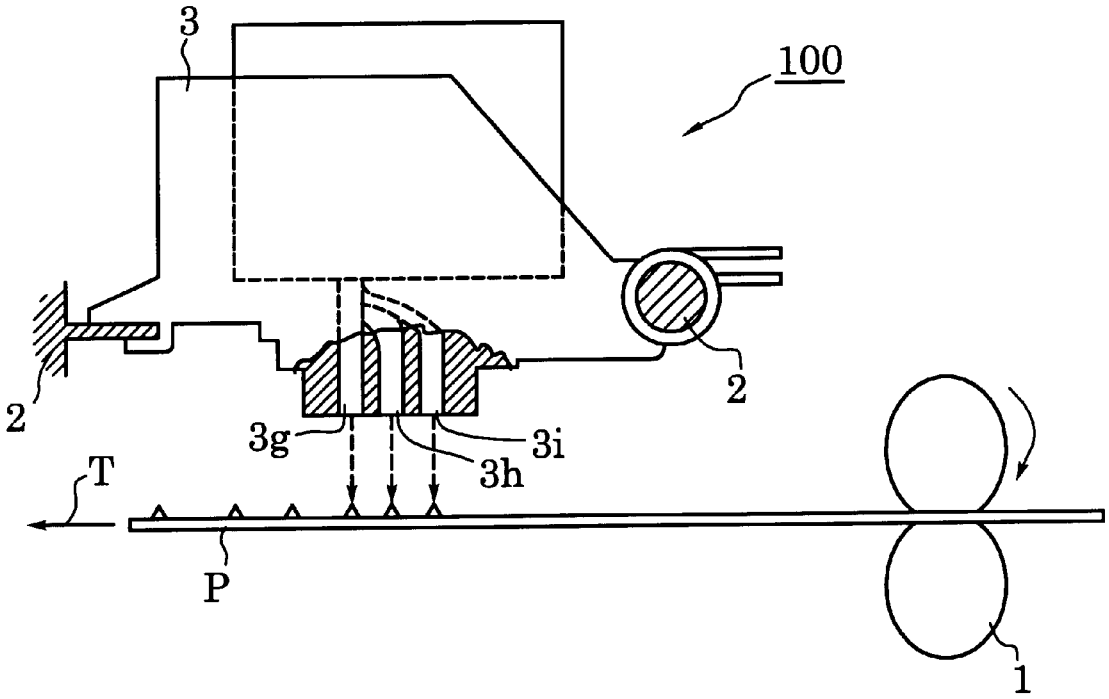
FIG. 3 is a side view of the image forming apparatus of FIG. 1 illustrating movement of a recording medium.

The ink-jet type image formation apparatus 100, as indicated in FIG. 3, forms the specified image on the recording medium P by transferring the recording medium P with the recording medium transfer member 1 and ejecting ink in accordance with the image information while causing the recording head carriage 3 to move with a back-and-forth motion in the transfer direction R as shown in FIG. 1.

Figure 4:
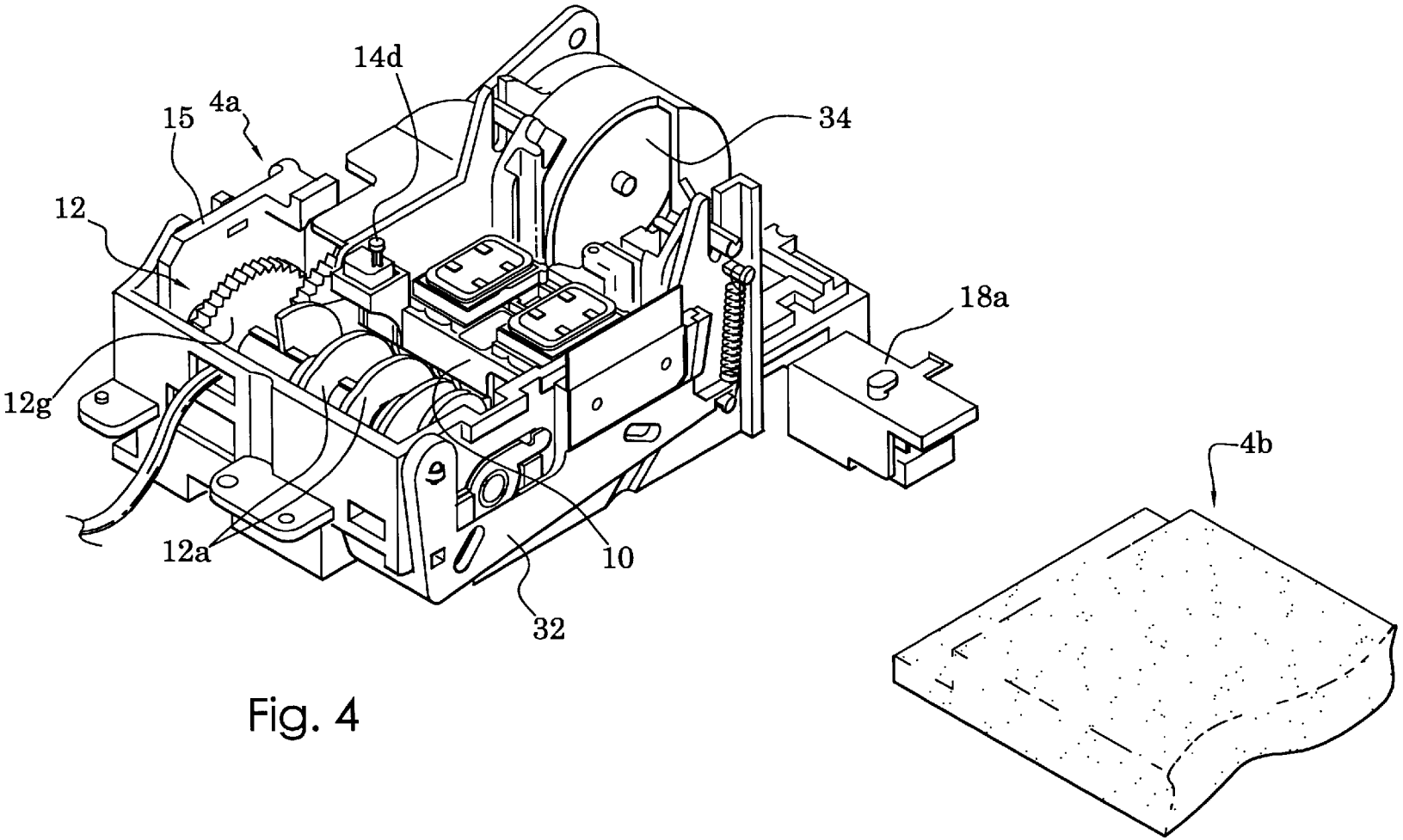
FIG. 4 is a perspective view of a maintenance station.

The maintenance station 4, as indicated in FIG. 4, comprises a station main body 4*a* and waste ink absorbing main body 4*b* which absorbs and holds the ink expelled from the station main body 4*a*.

Figure 5:
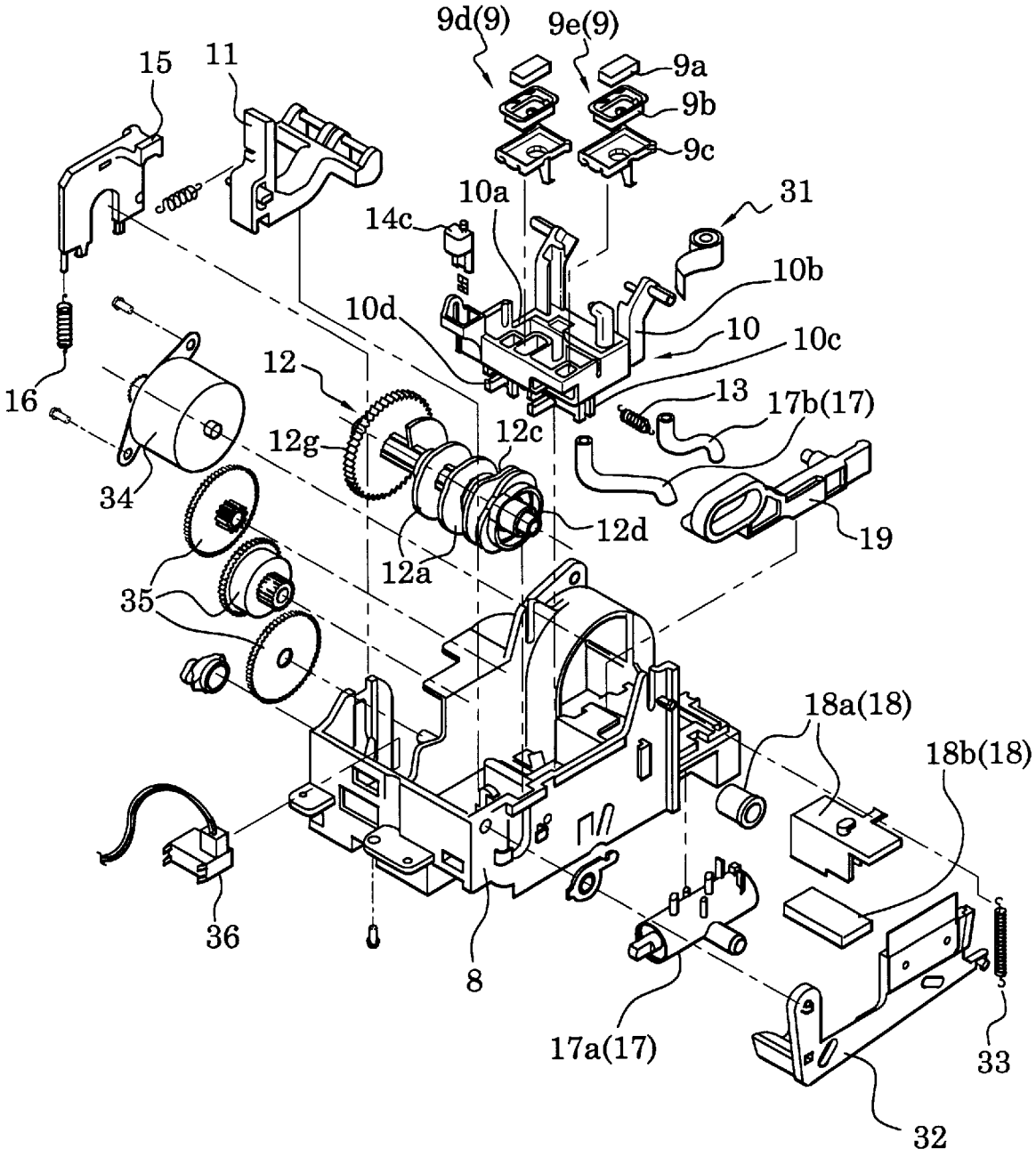
FIG. 5 is an exploded perspective view of the maintenance station of FIG. 4.

The station main body 4*a* comprises a unit housing 8 as shown in FIG. 5 and various members attached thereto.

In FIG. 5, an ink carrier 9*a* is formed by a sponge. A rubber cap member 9*b* has a concave portion formed therein that holds the ink carrier 9*a*, and also has a through-hole 9*f* formed therein and shown in FIG. 9 that extends through the concave portion to a side surface of the end member 9. A cap case 9*c* holds the cap member 9*b*. Moreover, the station main body 4*a* has left and right member assemblies 9*d* and 9*e*, which are held on a cap carriage 10. Each cap member assembly 9*a* and 9*e* includes one ink carrier 9*a*, one cap member 9*b* and one cap case 9*c*.

Figure 6:
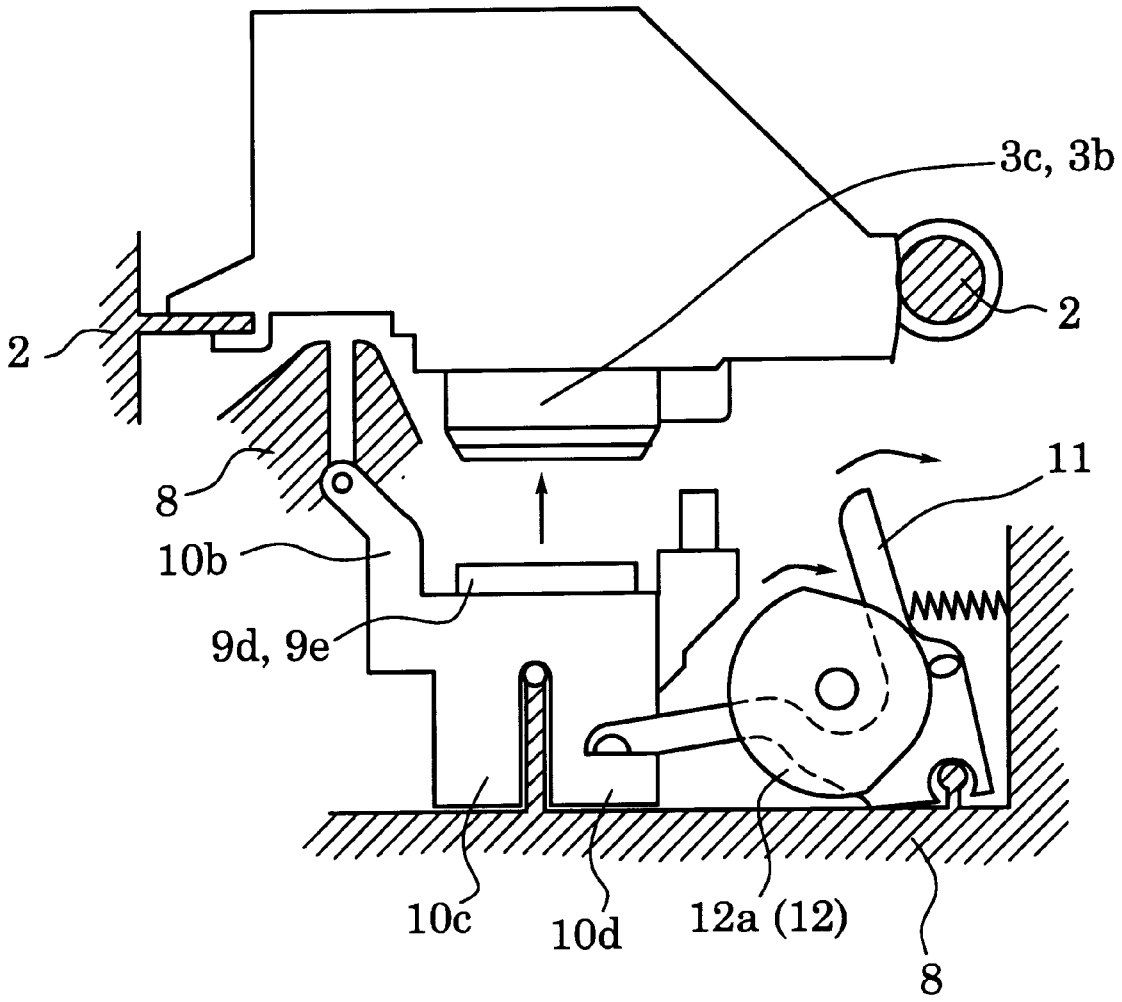
FIG. 6 is a side view of a cap member and a cam drive transfer.

The cap carriage 10 has assemblies bottom plate 10*a* that supports the left and right cap member assemblies 9*d* and 9*e*, a pair of arm structures 10*b* arranged at both ends of one side of the cap carriage, a guide member 10*c* disposed under the supporting bottom plate 10*a*, and a supporting member 10*d* disposed under the supporting bottom plate 10*a* and adjacent the guide member 10 *c*. As shown in FIG. 6, when the arm structures lob and guide member 10*c* are joined to the unit housing 8, the supporting member 10*d* is connected to an L-shaped arm 11, and the L-shaped arm 11 is able to move up and down (while maintaining its orientation) by being moved by a cam 12*a*. Hereafter, a member forming the cam 12*a* is called a cam drive transfer member 12.

Moreover, the cap carriage 10, as indicated in FIG. 7A–7D, is arranged so as to be movable in a same direction as the direction of movement of the recording head carriage 3, which is hereafter referred to as a left/right direction. A force is applied in a right side direction of the cap carriage 10 by a spring 13.

Figure 8:
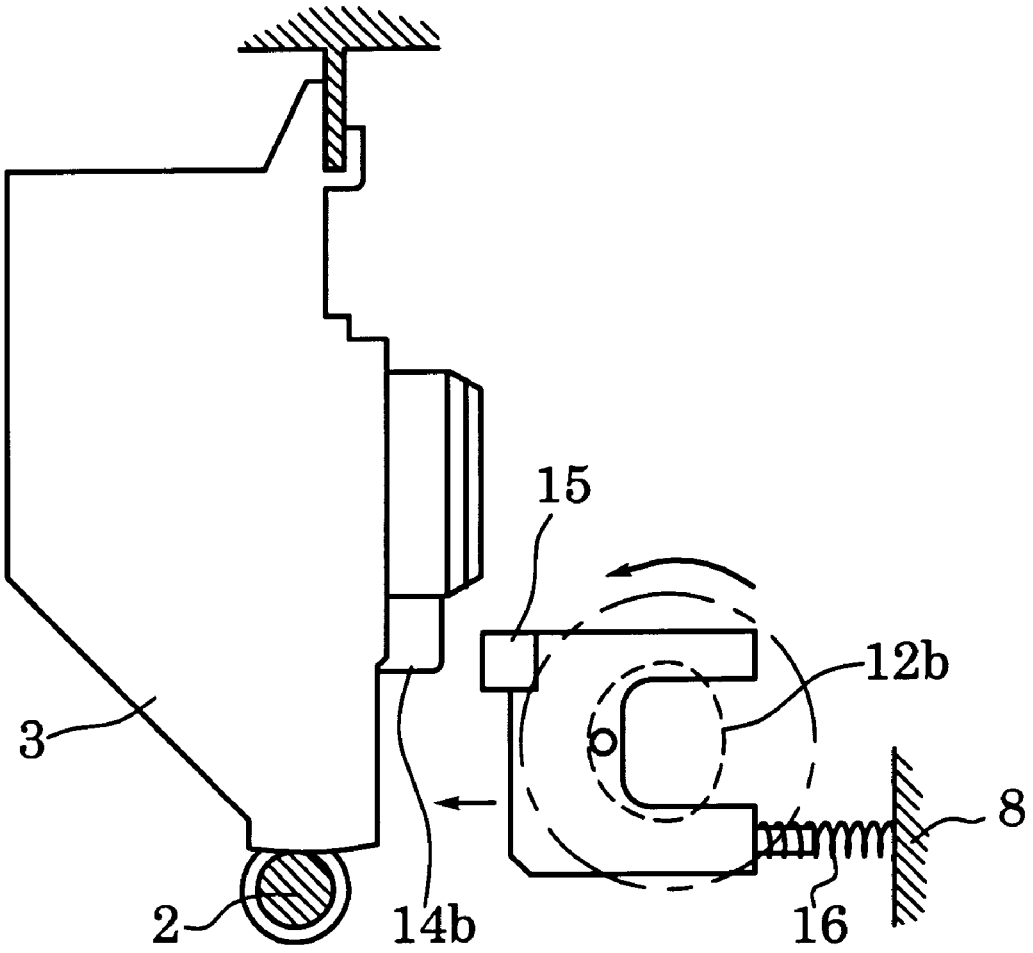
FIG. 8 is a side view of the cap carriage engaging member and the carriage position fixing member of FIGS. 7A–7D illustrating a locking operation.

Moreover, on the recording head carriage 3 are formed two projections 14*a* and 14*b* that are positioned next to the two nozzle members 3*b* and 3*c*. An engagement pin 14*c* is arranged on the cap carriage 10 in a position that corresponds to a path of motion of the two projections 14*a* and 14*b*. A fixing pin 15 is arranged near the engagement pin 14*c* so that it is movable in an up-and-down direction in the station main body 4*a*. The fixing pin 15, as indicated in FIG. 8, is biased upwards by a second spring 16 that is inserted between the unit housing 8 and the fixing pin 15.

The fixing pin 15 also engages a channel 12*b* of a gear 12*g* of the cam drive transfer member 12, thereby setting the height of the fixing pin.

Figure 7A:
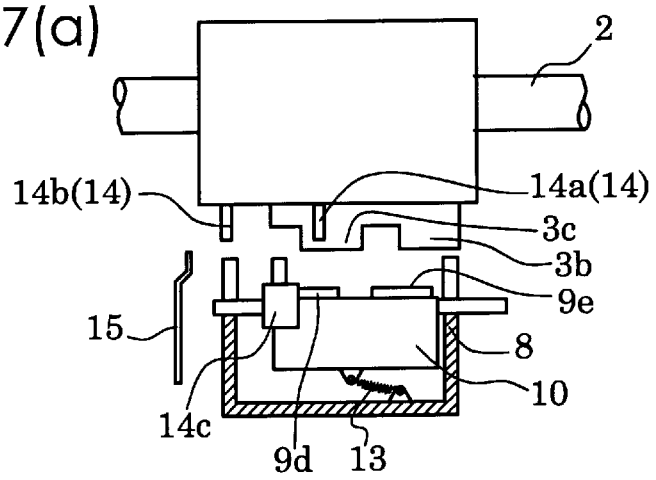
FIGS. 7A–7D are side views of a cap carriage engaging member and a carriage position fixing member illustrating a capping operation.
Figure 7B:
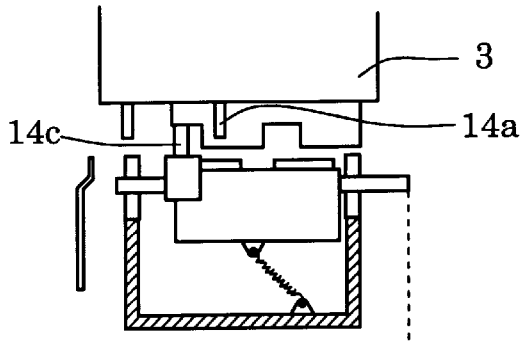
Figure 7C:
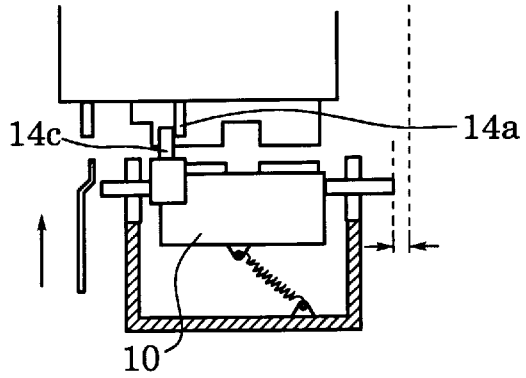
Figure 7D:
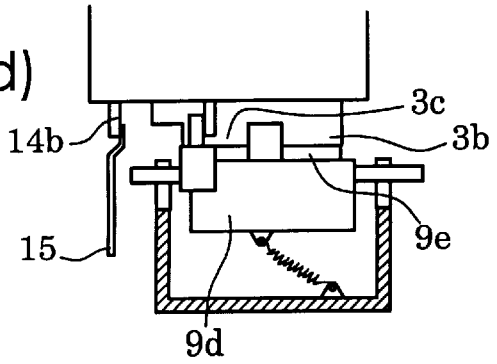

Then, the station main body raises the cap carriage 10 to a height at which the engagement pin 14*c* and the projection 14*a* can engage as best shown in FIG. 7B. The engagement pin 14*c* and the projection of 14*a* are then engaged by moving the recording head carriage 3 to the left side, and the cap carriage 10 is moved slightly to the left side as shown in FIG. 7C. Assured capping is possible when the cap carriage 10 is raised and the cap member assemblies 9*d* and 9*e* are pressed against the nozzle members 3*b* and 3*c* as shown in FIG. 7D. At the station main body 4*a*, when the cap member assemblies 9*d* and 9*e* are pressed against the nozzle members 3*b* and 3*c*, the fixing pin 15 and the engagement pin 14*c* can be inserted between the two projections 14*a* and 14*b* and the recording head carriage 3 can be fixed by raising the fixing pin 15 to engage the left side projection 14*b*.

Figure 9:
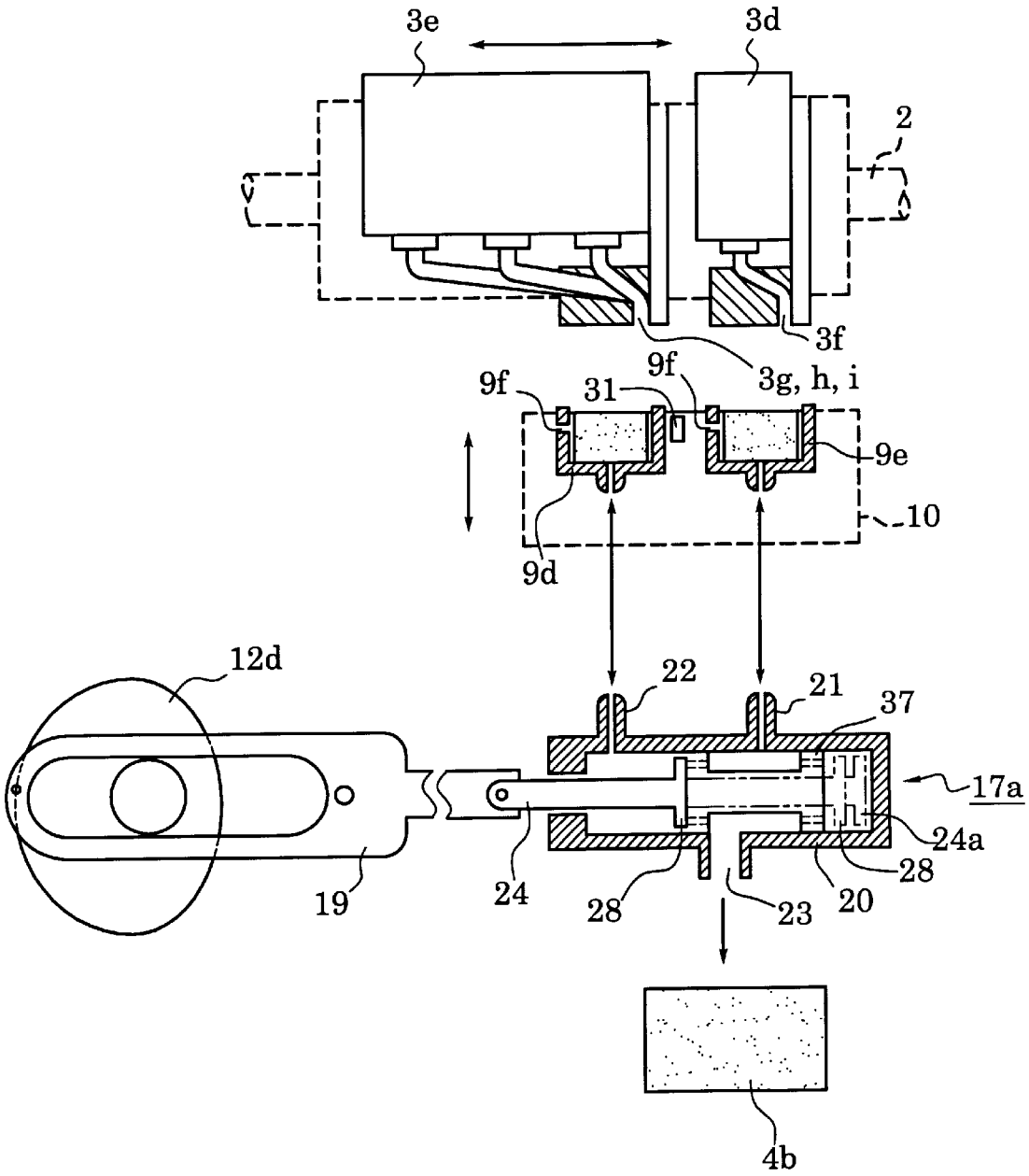
FIG. 9 is a partial cross-sectional side view of a pump member.
Figure 10A:
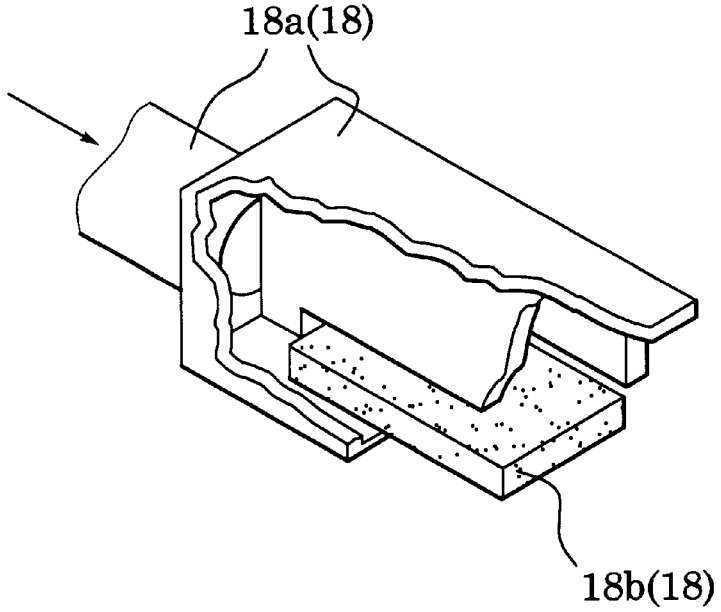
FIG. 10A is a partial perspective view of a waste ink conductor.

Further, in FIGS. 5 and 9, an ink suction pump 17*a* with two hoses 17*b* is connected to each cap member assembly 9*d* and 9*e*. These elements form an ink suction pump assembly 17. The ink in the each cap member assembly 9*d* and 9*e* can be suctioned by the single ink suction pump 17*a*. Moreover, a waste ink conductor 18 is connected to an ink expulsion port 23 (shown in FIGS. 9 and 11) of the ink suction pump 17*a* by a connection part 18*a*, shown in FIGS. 5, 10A and 10B and is structured so that ink is expelled to the waste ink absorbing main body 4*b* from the waste ink conductor 18.

Figure 10B:
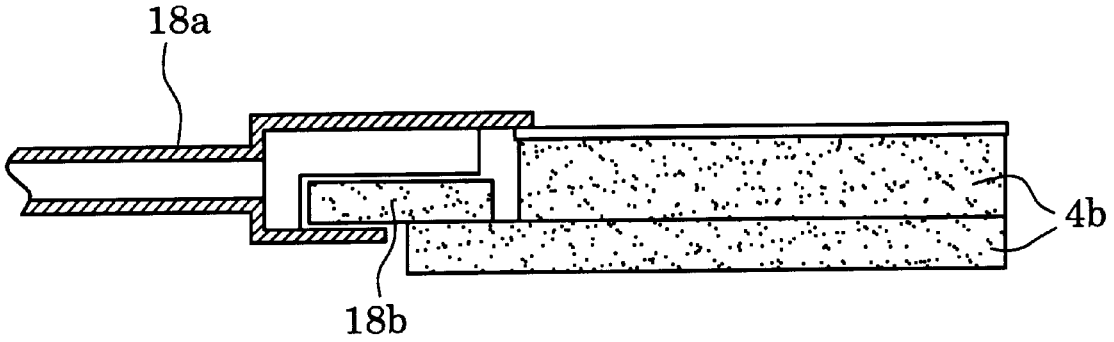
FIG. 10B is a cross-sectional side view of the waste ink conductor of FIG. 10A.

Since the ink suction pump 17*a* and the waste ink absorbing main body 4*b* are arranged in approximately horizontal positions, as indicated in FIG. 10B, a sponge 18*b* is arranged at an exhaust port of the waste ink conductor 18 in order to avoid dripping of waste ink when the ink absorbing main body 4*b* is exchanged.

Figure 11:
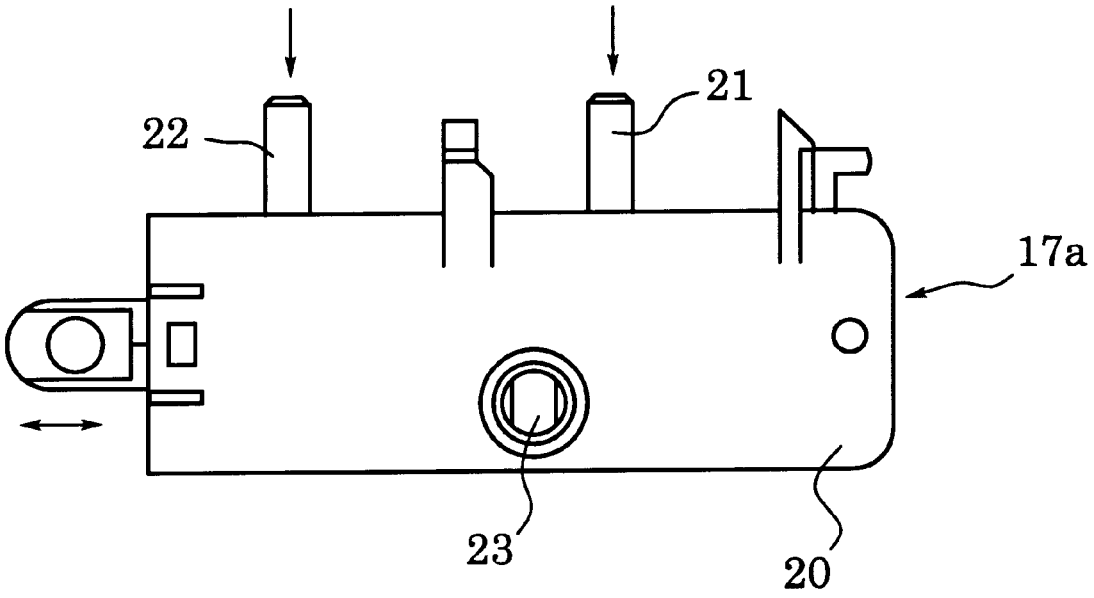
FIG. 11 is a front elevational view of the pump.

As shown in FIG. 11, the ink suction pump 17*a* has two ink absorbing ports 21 and 22 formed in an upper portion of a cylinder 20. The ink expulsion port 23 is formed in a bottom center part of the cylinder 20 in order to make the ink expel easier. Hereafter, the ink absorbing port 21 that is connected to the right side cap member assembly 9*e* is called the right side ink suction port, while the ink absorbing port 22 that is connected to the left side cap member assembly 9*d* is called the left side ink suction port.

Figure 12:
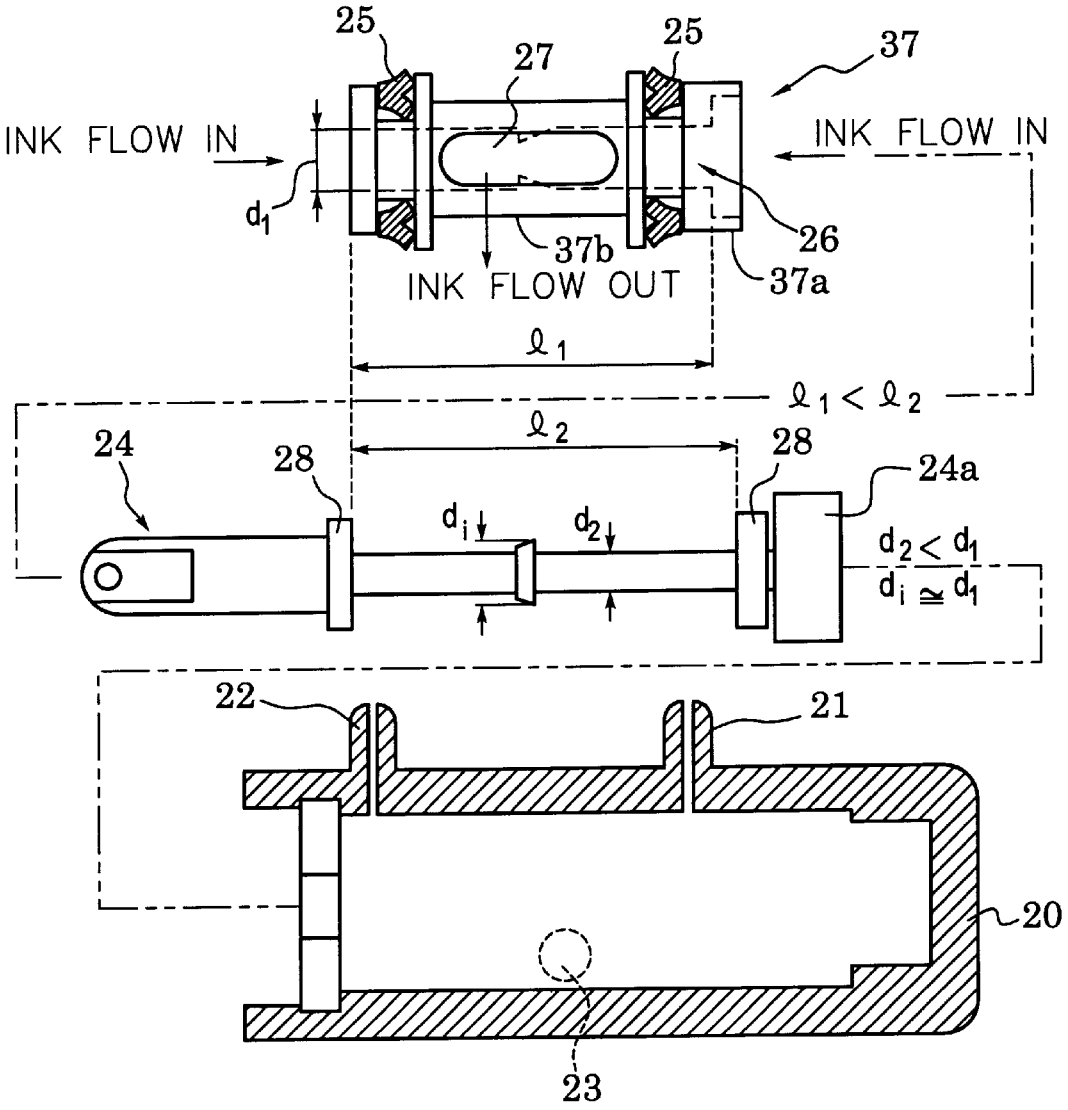
FIG. 12 is an exploded side view of the pump.
Figure 13A:
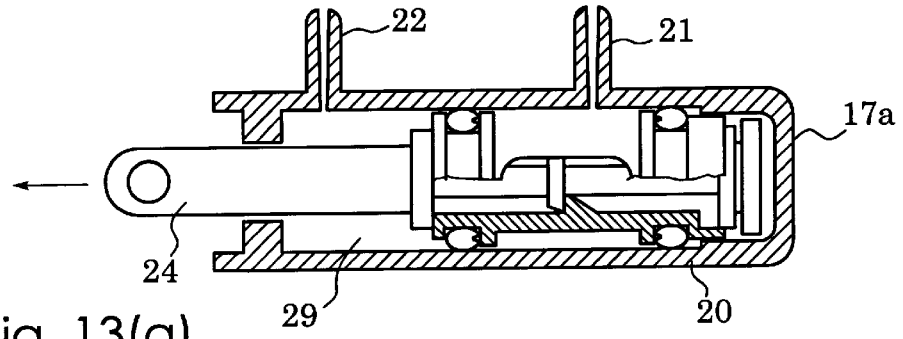
FIGS. 13A–13D are cross-sectional side views of the pump at various operational points.
Figure 13B:
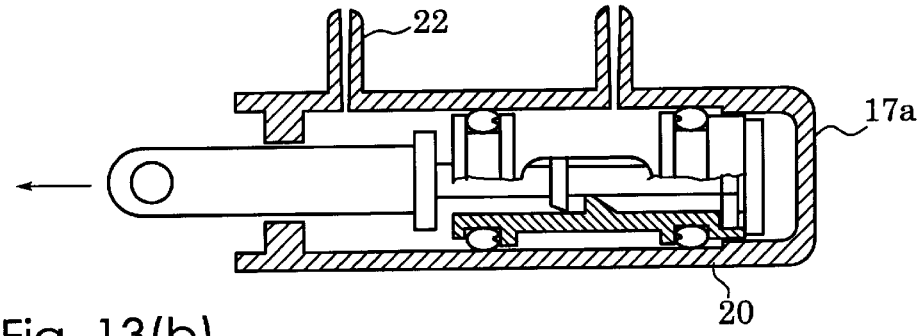
Figure 13C:
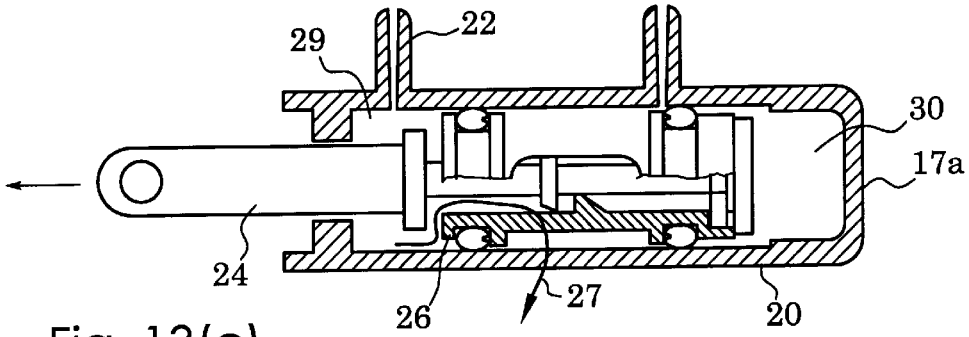
Figure 13D:
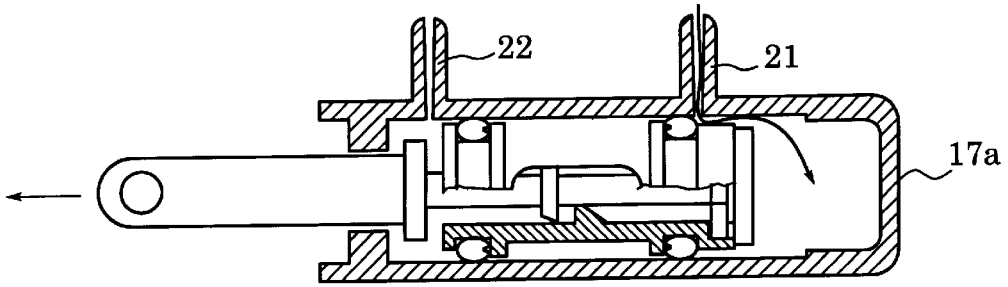

Moreover, as indicated in FIG. 12, the cylinder 20 receives a piston 37, including a piston head 37*a* and a piston head body 37 *b*, that is sized to fit within an inner circumferential surface of the cylinder 20. The piston head 37*a* and piston head body 37*b* have a through-hole 26 formed in the center portion thereof and a piston rod 24, that is formed with a diameter d2 that is smaller than the diameter of the through-hole 26 is inserted through the through-hole 26.

Specifically, the piston head 37*a* comprises a pair of silicon rubber piston rings 25, one at each end of the piston head and positioned around the circumference thereof, and an ink drain port 27 formed in a side of the piston head body 37*b* between the piston rings 25 and in communication with the through-hole 26.

The piston rod 24 has a pair of through-hole sealing plates or members 28 that are sized to seal the through-hole 26 of the piston head 37*a*. The sealing members 28 are arranged between an end member 24*a* of the piston rod 24 and an end of the piston 37 at a spacing $l_2(>l_1)$ that is slightly longer than the length $l_1$ of the through-hole 26 of the piston head 37*c*.

Further, each sealing member 28, respectively, comprises silicon rubber. Also, the piston rod 24 is connected to the cam of the cam drive transfer member 12 through drive transfer arm 19 shown in FIG. 9.

Figure 14A:
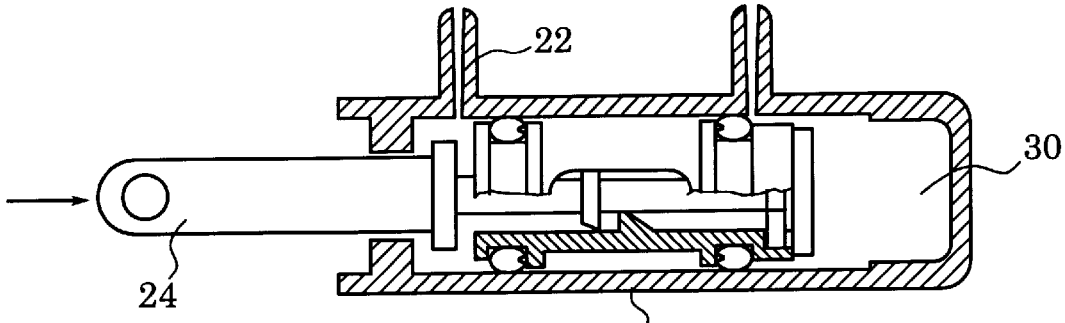
FIGS. 14A–14C are cross sectional views of the pump at various operational positions.
Figure 14B:
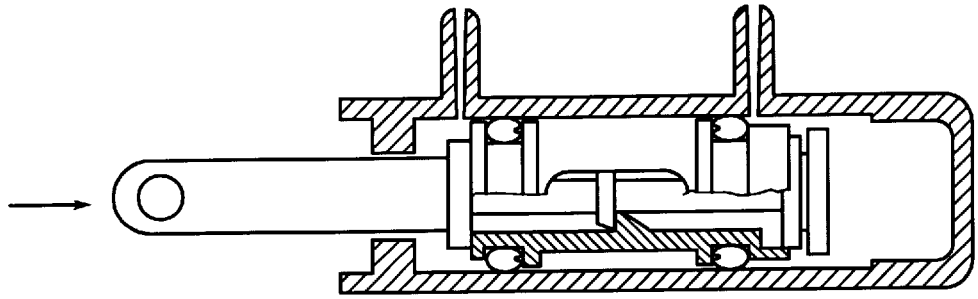
Figure 14C:
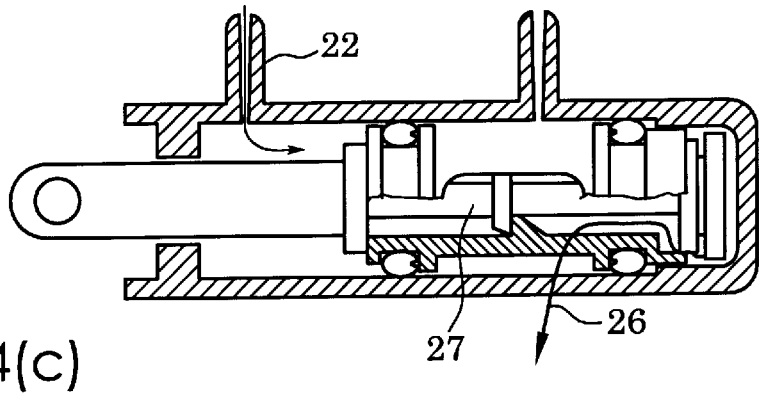

The ink suction pump 17*a*, as shown in FIGS. 13A–13D, suctions in ink from the right side ink suction port 21, and also expels ink held in a left side chamber 29 of the cylinder 20 through the through-hole 26 and the ink expulsion port 23 (shown in FIG. 9) via the ink drain port 27. Moreover, as indicated in FIGS. 14A–14C, the ink suction pump suctions ink away from the left side ink suction port 22 as the piston rod 24 is pushed back, and the waste ink which was kept in the right side chamber 30 of the cylinder 20 is expelled from the ink expulsion port 23 (FIG. 9) via the through-hole 26 and the ink drain port 27.

Figure 15:
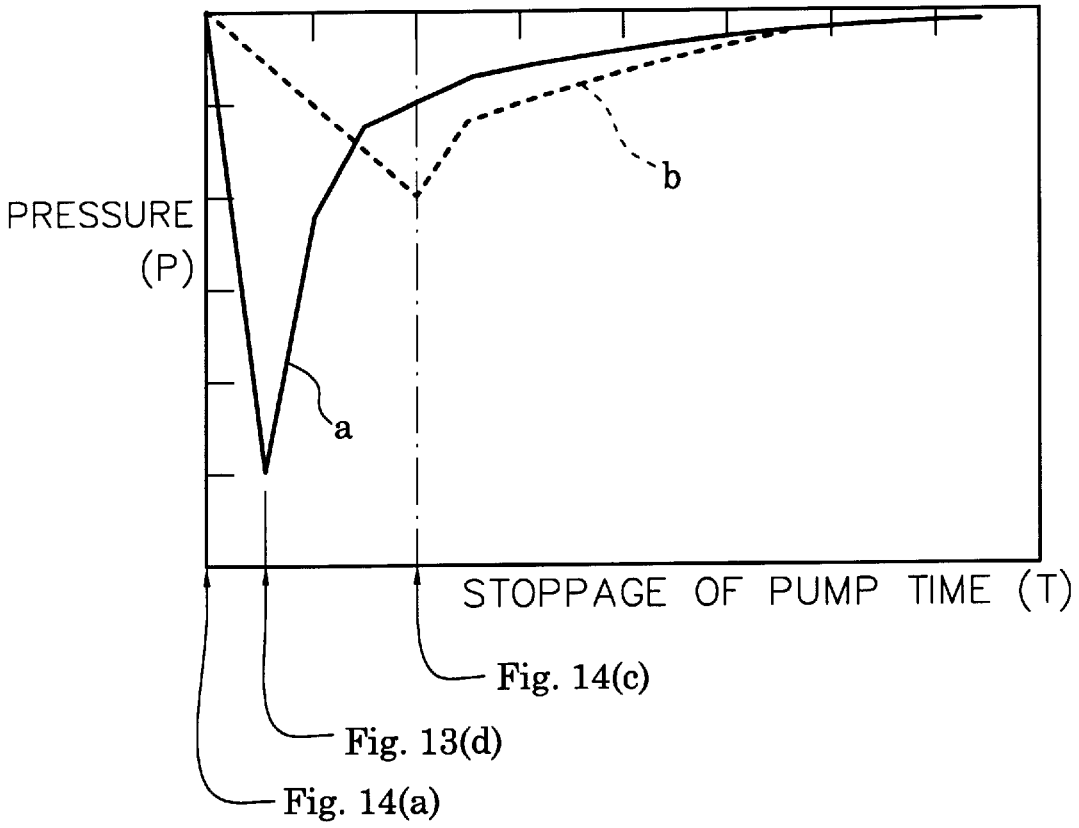
FIG. 15 is a chat-reflecting a suction pressure of the pump as a function of time.

Further, in this embodiment, the right side ink suction port 21 is formed toward the center of the cylinder 20. After the piston head 37*a* is moved to a certain degree and the pressure in the suction chamber is lowered to a prescribed pressure, the right side ink suction port 21 connects with the interior of the cylinder 20 to apply suction pressure to the nozzle part. As shown in line "a" in FIG. 15, it is possible to supply high pressure at a moment's notice during ink suction. On the other hand, a left side ink suction port 22 suctions the ink in an operation that accompanies the motion of the piston head 37*a* as shown in line "b" of FIG. 15, by arranging it toward the end part of the cylinder 20. As a result, a right side ink suction port 21 properly removes tacky ink clogged in 10 the nozzle part, removes air bubbles in the nozzle part, and even performs the refilling (recovery) of ink in the nozzle part of the small amount of ink that has been expelled. Also, a left side ink suction port 22 properly suctions ink remaining in the cap member 9.

Figure 16A:
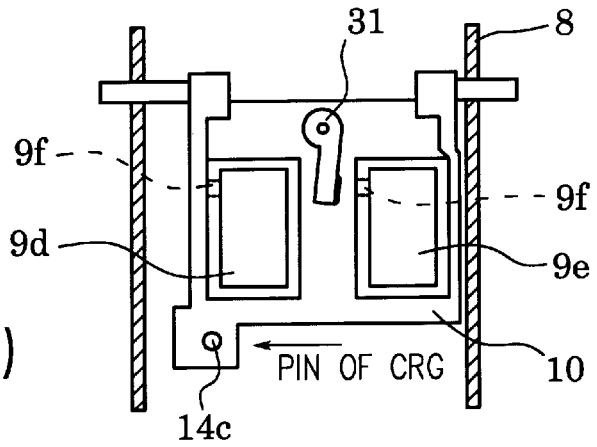
FIGS. 16A–16C are side views of a cap member having a through hole and disposed in a sequence of positions.
Figure 16B:
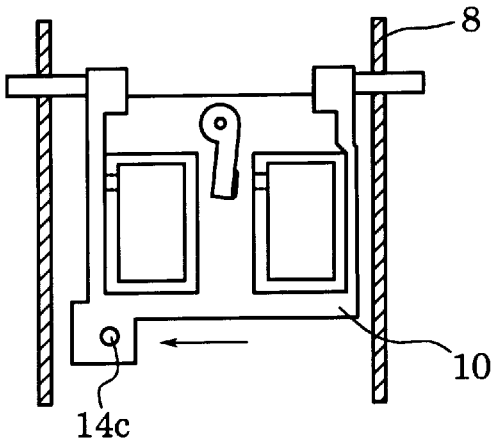
Figure 16C:
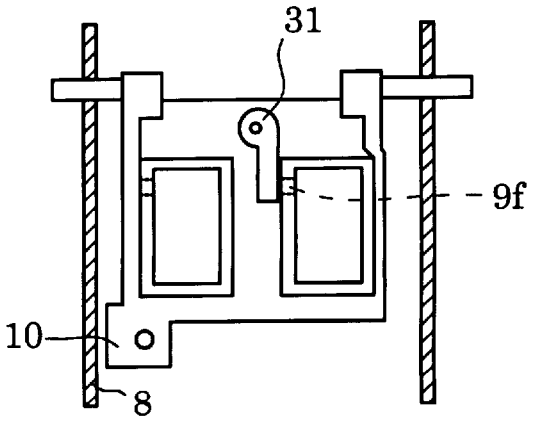

Next, in FIG. 5, a cap through-hole sealing member 31 seals the through-hole 9*f* (FIG. 9) of the right side cap member assembly 9*e*, and is arranged on the cap carriage 10. Further, the cap through-hole sealing member 31, as indicated in FIG. 16*a*–16*c*, is structured such that the cap carriage 10 is pushed by the recording head carriage 3 and seals the through-hole 9f by moving to the left side.

Figure 17A:
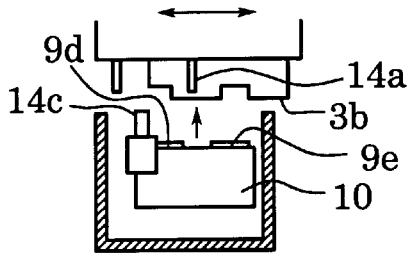
FIGS. 17A–17E are partial cross-sectional views of a right side nozzle.
Figure 17B:
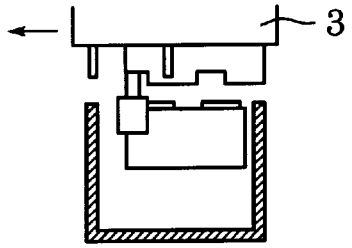
Figure 17C:
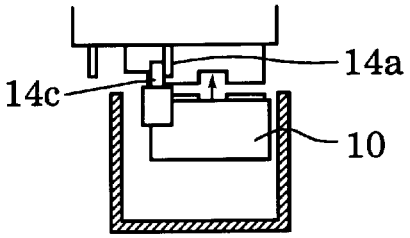
Figure 17D:
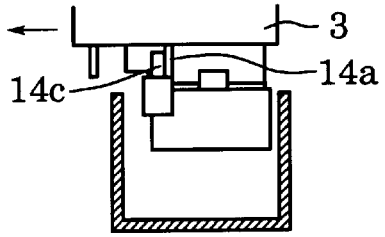
Figure 17E:
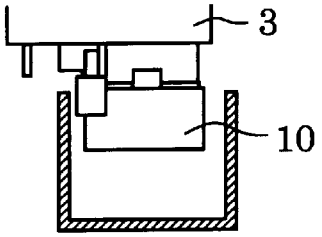

As shown in FIGS. 17A–17E, the station main body 4*a* causes the projection 14*a* on the right side to engage with the engagement pin 14*c* and covers the black ink nozzle member 3*b* with the right side cap member assembly 9*e*. Also, the station main body moves the recording head carriage 3 to the left side and seals the through-hole 9*f* of the right side cap member assembly 9*e* on the right side with the cap through-hole sealing member 31 as shown in FIGS. 17A and 16C. By operating the pump 17*a* in this state, it is possible to suction foreign material such as ink that has increased in viscosity within the black ink nozzle member 3*b*.

Figure 18A:
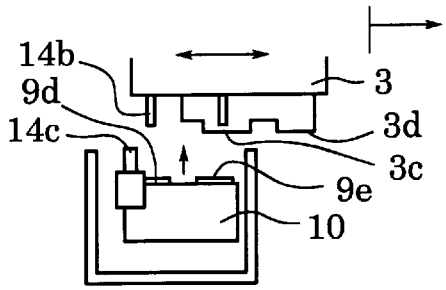
FIGS. 18A–18E are partial cross-sectional side views of a left side nozzle disposed in a sequence of left side nozzle positions.
Figure 18B:
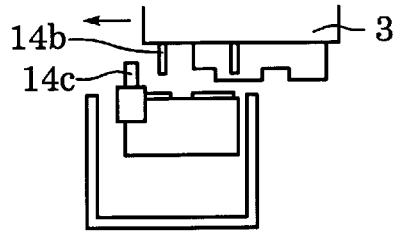
Figure 18C:
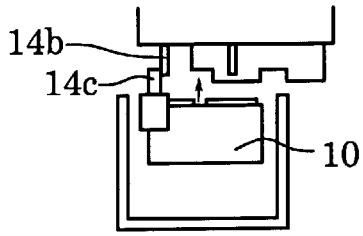
Figure 18D:
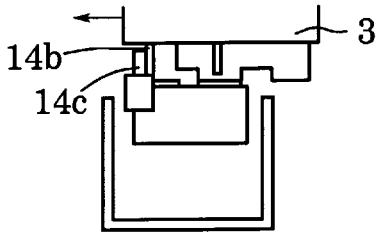
Figure 18E:
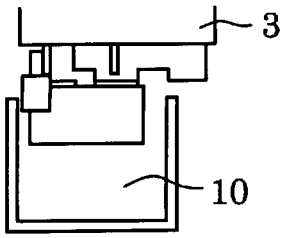

Moreover, as shown in FIGS. 18A–18E, the station main body 4*a* causes the projection 14*b* on the left side to engage with the engagement pin 14*c*, and covers the color nozzle 3*c* by the right side cap member assembly 9*e*. The recording head carriage 3 is moved to the left side and seals the through-hole 9*f* of the right side cap member assembly 9*e* with the cap through-hole sealing member 31 as shown in FIG. 18E. By operating the pump 17*a* in this state, it is possible to suction foreign material such as ink that has increased in viscosity within the color nozzle member 3*c*.

Furthermore, the station main body 4*a* positions the recording head carriage 3 so that each of the nozzle members 3*b* and 3*c* face the respective cap member assemblies 9d and 9*e* as shown in FIG. 17A. Ink is ejected from nozzle members 3*b* and 3*c* and received at each cap member assembly 9*d* and 9*e*, and the ink is suctioned away as the ink suction pump 17*a* is operated with the carriage in this state.

Moreover, as shown in FIG. 5, a wiper 32 has a rubber blade. A force is applied by a third spring 33 provided between the station main body 4*a* and the wiper. The height of the wiper 32 can be set by pushing down on the wiper through the cam drive transfer member 12. Also, as shown in FIG. 19B, ink absorbing bodies 3*j* and 3*k* are made from sponges.

Figure 19A:
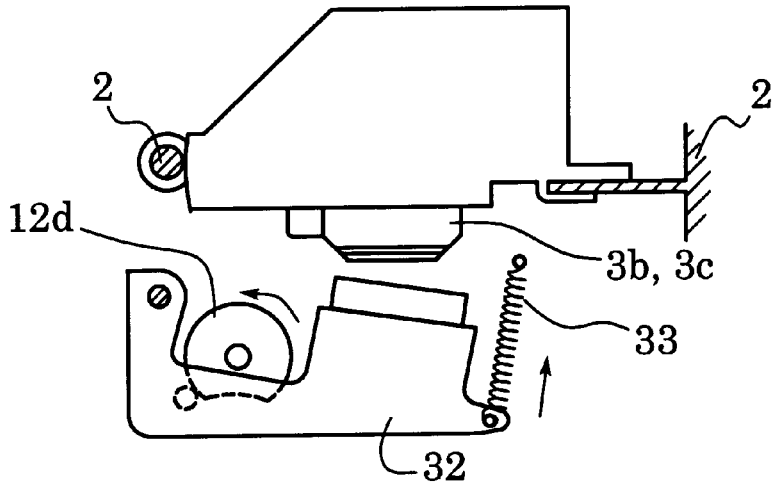
FIG. 19A is a side elevational view of a wiper member.
Figure 19B:
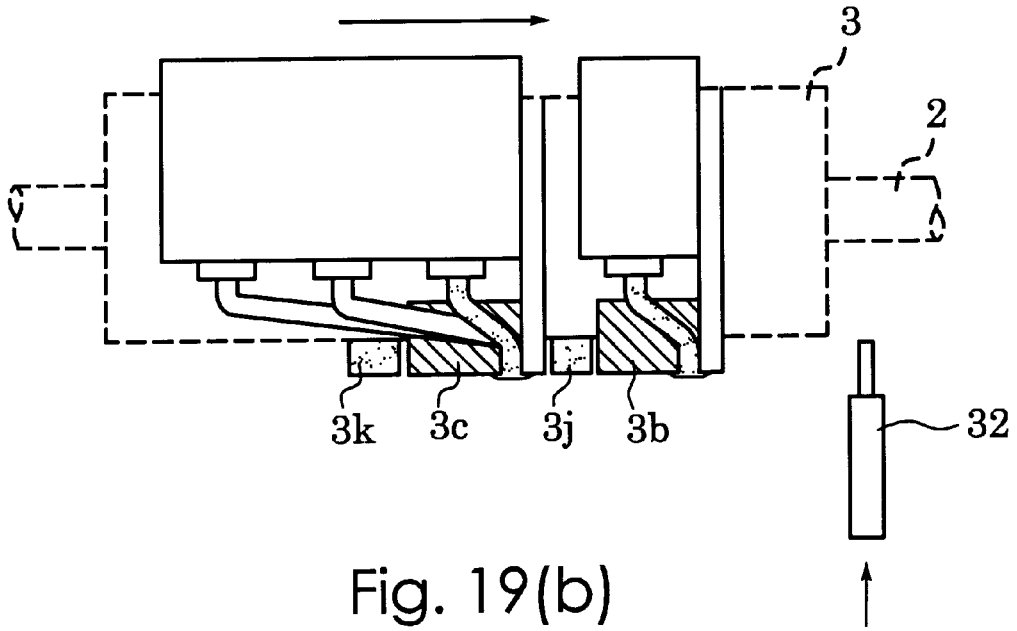
FIG. 19B is a top plan view of the wiper member in FIG. 19A.

Further, as shown FIGS. 19A and 19B, the station main body 4*a* is moved such that a blade edge of the wiper 32 is positioned in the path of movement of the nozzle members 3*b* and 3*c*, and the recording head carriage 3 is moved from the home position to the right side. Thus, the blade edge can contact an edge of each nozzle member 3*b* and 3*c*.

Moreover, after contacting the edge of the each nozzle member, the blade edge is cleaned by the ink absorbing bodies 3*j* and 3*k* so that the black ink does not mix with the color ink.

Finally, FIG. 5, illustrates a pulse motor 34, the cam drive transfer member 12, a gear train 35 that transfers the rotation of the pulse motor 34 to the cam drive transfer member 12, and a sensor 36 that detects the rotating phase of the cam drive transfer member 12 via cam member 12*h*. The drive means includes these elements.

Figure 23:
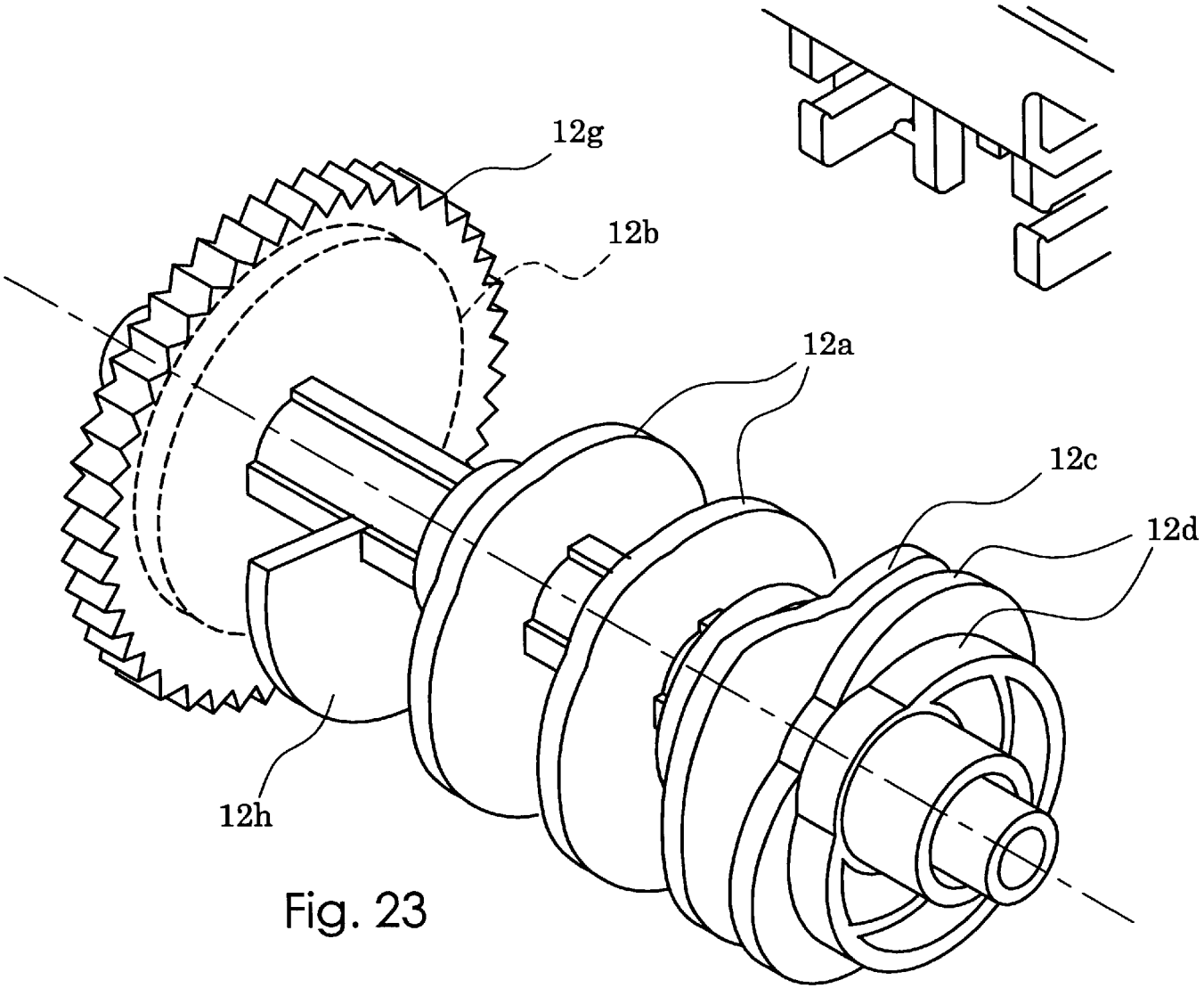
FIG. 23 is a perspective view of a cam drive transfer member.

As shown in FIG. 23, the cam drive transfer member 12, as described above, comprises the cam 12*a* for capping that moves the cap member assemblies 9*d*, 9*e* and the like vertically, a channel 12*b* in a gear 12*g* that moves the fixing pin 15 vertically, a pumping cam 12*d* that drives the pump 17*a*, a wiping cam 12*c* that moves the wiper 32 vertically, and a cam member 12*h* for the sensor 36.

Figure 20:
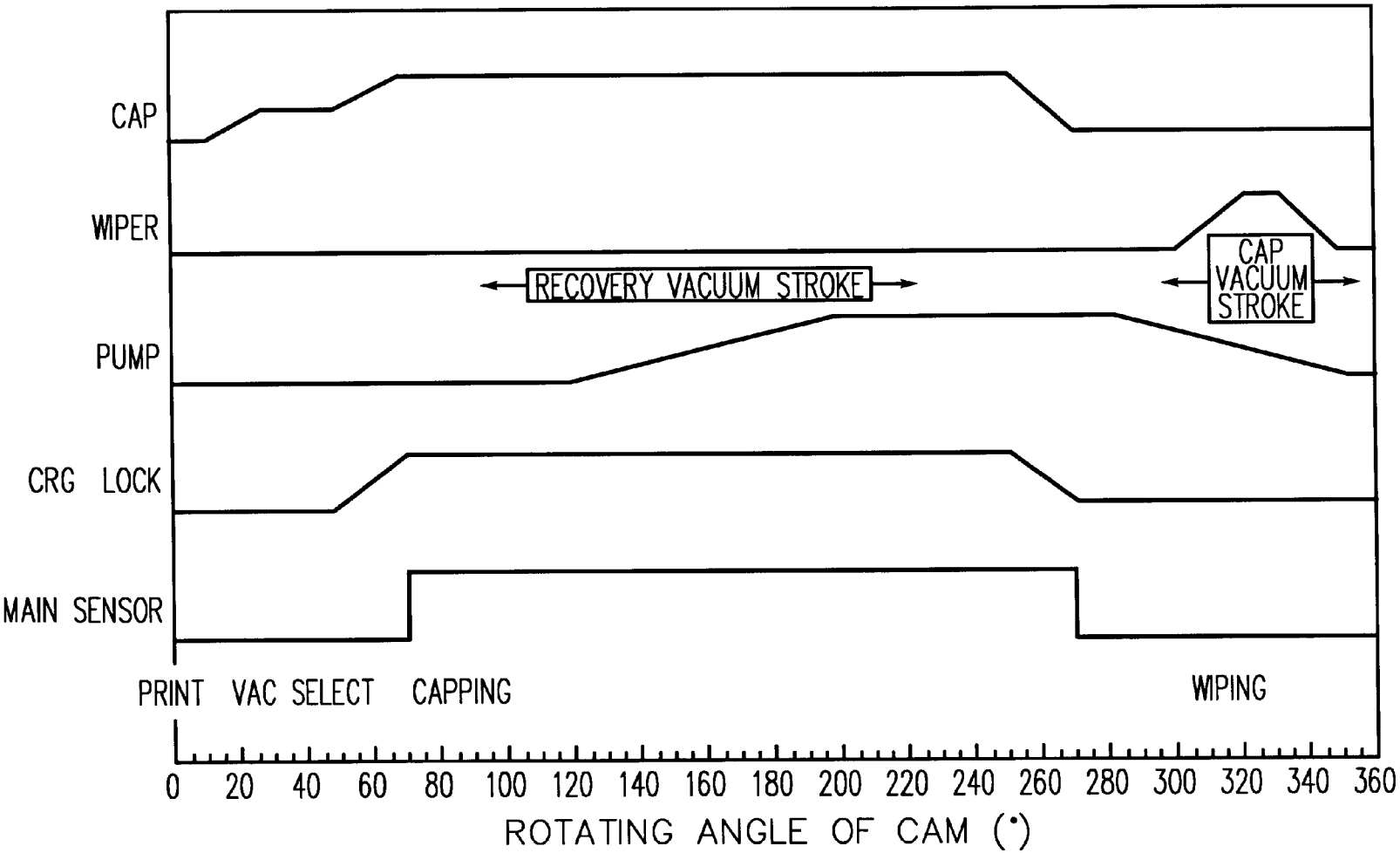
FIG. 20 is a chart illustrating respective conditions of the cap member, the wiper member, the pump, the CRG lock and a main sensor as a factor of a CAM angle.

Also, the cams are formed so as to drive each respective member against a fixed rotating phase of the cam drive transfer member 12 as shown in FIG. 20. To describe FIG. 20 more specifically, an image forming mode is allotted in which all of the members 9*d*, 9*e*, 14*c*, 15 and 32 are in a retreated position in a rotating range of 350°–10° of the cam, a cap position-determining mode is allotted in which the cap carriage 10 is raised to a half position when in the rotating range 30°–50°, a carriage stopping mode is allotted in which cap member assemblies 9*d* and 9*e*, the engagement pin 4*e* and the fixing pin 15 are raised when in a rotating range of 70°–120°, a vacuum mode is allotted in which the pump 17*a* is driven in a condition in which cap member assemblies 9*d* and 9*e*, the engagement pin 14*c* and the fixing pin 15 are raised when in a rotating range of 120°–200°, a cap interior space vacuum mode is allotted in which a pump 17*a* is driven in the condition in which the cap member assemblies 9*d* and 9*e*, the engagement pin 14*c* and the fixing pin 15 are retreated when in a rotating range of 280°–350°; and a wiping mode is allotted in which the wiping member 32 is raised when in a rotating range of 320°–330°. The cap interior space vacuum mode is used for suctioning the ink discharged from the dummy jet.

Also, the pulse motor 34 in the vacuum mode or dummy jet may be rotated counter-clockwise a fixed number of times when each cap member assembly 9*d* and 9*e* is suctioned a plurality of times.

Then, in this embodiment, when an image is not being formed, not only is the recording head carriage 3 set in the home position, but it is also set in a carriage stopping mode. Also, when image forming begins, it is set so that it enters into the image forming mode after executing the dummy jet and wiping mode. After image forming has been completed, it is further set so that it goes to the carriage stopping mode after executing the cap position-determining mode. Moreover, experiments were conducted in which, based on a command by the user, it was set so as to execute the vacuum mode.

As a result, in the ink-jet type image forming apparatus, there is no clogging of nozzle members 3*b* and 3*c* when they are used for a long period of time and there is no failure of image forming. Also, even if clogging of the nozzle members 3*b* and 3*c* were to occur after this period of time, it would be possible to recover immediately.

Moreover, in the ink-jet type image forming apparatus of this invention, with the one pulse motor, it is possible to position-determine the cap member assemblies 9*d* and 9*e* the wiper member 32, the fixing pin member 15 and the cap through-hole sealing member 31 so that they advance with respect to the path of motion of the recording head carriage. Also, since the pump 17*a* is operated, and moreover, because one ink suction pump suctions the ink from all of the cap member assemblies 9*d* and 9*e*, there is no need to install a drive means individually for each member, thus making it possible to greatly reduce the size of the apparatus.

In this embodiment, suction tests were performed via the vacuum mode in which the hardness of the sealing member 28 and the hardness of the piston rings 25, respectively, were altered along hardnesses of 20–80 Hs.

Figure 21:
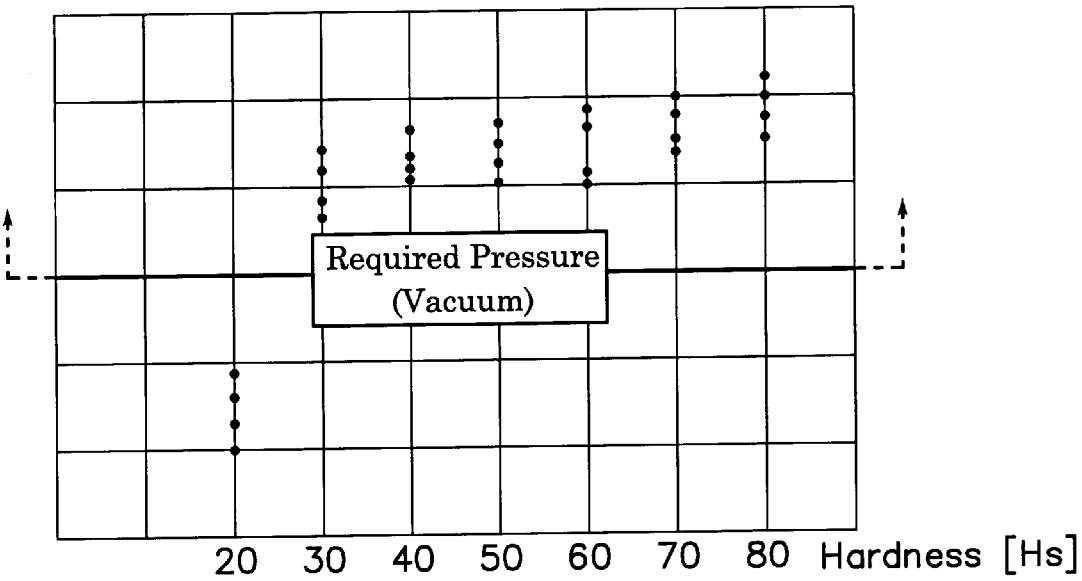
FIG. 21 is a graph showing the relationship between the hardness of the piston ring and the suction pressure.
Figure 22:
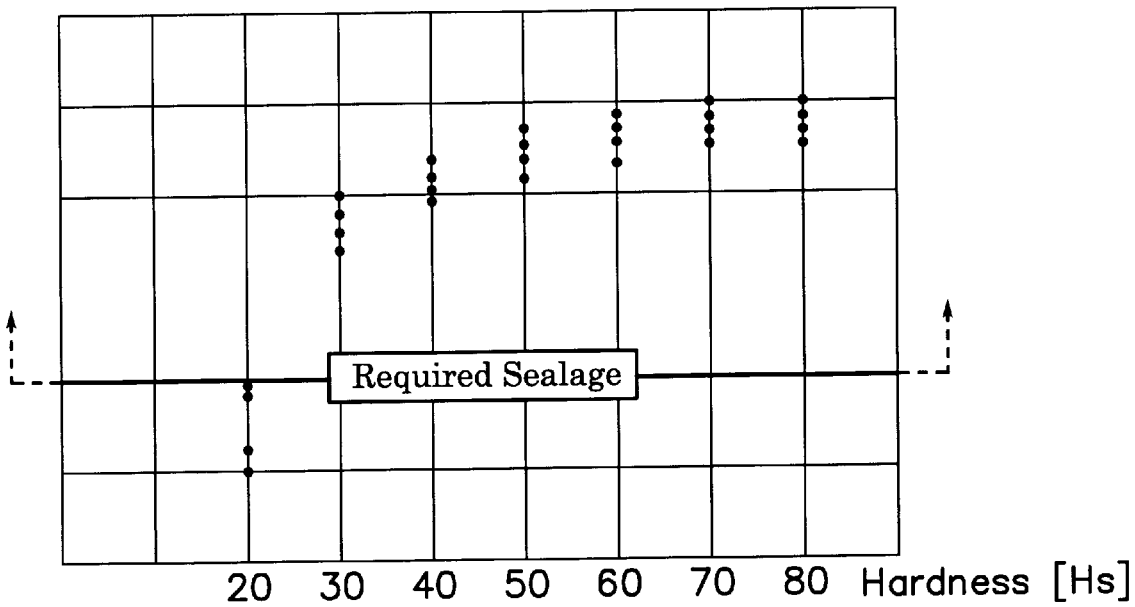
FIG. 22 is a graph showing the relationship between the hardness of the sealing member and the sealing property.

As a result, as shown in FIG. 21, it is possible for the piston rings 25 to obtain a sufficient suction pressure in a hardness equal to or greater than 30 Hs and, as shown in FIG. 22, it is possible for the sealing member to obtain a sufficient sealing property in a hardness equal to or greater than 30 Hs.

As described above, in the ink-jet type of image forming apparatus of the present invention, an ink suction pump is formed by a cylinder comprising an interior space and two ink suction ports that pass through to this interior space, and by a piston arranged to be movable in this interior space. Each of the ink suction ports is connected respectively to a different cap member. Furthermore, it is possible not only to miniaturize the apparatus by eliminating space necessary in the ink suction pump, but it is also possible to effectively absorb ink from the plurality of cap members connected to each ink suction port, because it is possible to move the piston inside the cylinder to absorb ink interchangeably from each ink suction port.

What is claimed is:

1. An ink-jet type image forming apparatus, comprising:

a recording head having a plurality of nozzle components for ejecting ink in accordance with image information;

a plurality of cap members for covering the nozzle components; and an ink suction pump connected to the cap members, the ink suction pump suctioning the ink in the cap members, the ink suction pump including a cylinder having an interior space and two ink suction ports passing through the interior space, and a piston movably arranged in the interior space, each of the ink suction ports being connected to different cap members, and the piston being movable between the two ink suction ports;

wherein the piston includes a piston head and a piston head body having a through-hole formed therethrough and a drain port formed in a side of the piston head body in communication with the through-hole.

2. The ink-jet type image forming apparatus according to claim 1, further comprising:

an ink expulsion port provided between the two ink suction ports in the cylinder and an ink expulsion path that passes through ink suction chambers that are formed on both sides of the piston and the ink expulsion port and through the drain port.

3. The ink-jet type image forming apparatus according to claim 2, wherein:

the piston head body is formed smaller than the interior space of the cylinder; and a pair of piston rings are placed on opposite sides of the piston head body, the piston rings being formed in a shape of a letter V or Y in cross section, and the pair of piston rings being positioned on the piston head body in a state in which grooves of each ring face each other.

4. The ink-jet type image forming apparatus according to claim 3, wherein the piston rings are formed of silicon rubber having a hardness of at least 30 Hs.

5. The ink-jet type image forming apparatus according to claim 3, wherein the sealing members are formed of silicon rubber having a hardness equal to or more than 30 Hs.

6. The ink-jet type image forming apparatus of claim 3, wherein the sealing members comprise silicon rubber of a hardness equal to or more than 30 Hs.

7. The ink-jet type image forming apparatus of claim 1, wherein a through-hole is provided in the cap member so that suction in the interior space is applied to the nozzle when the through-hole is covered.

8. The ink-jet type image forming apparatus of claim 7, further comprising a cap through-hole sealing member, movable against the through-hole of one of the cap members, so as to seal said through-hole, wherein the ink is suctioned from all nozzles by the cap member to which the cap through-hole sealing member is contacted.

9. The ink-jet type image forming apparatus according to claim 8, wherein the plurality of cap members are arranged on one cap carriage;

a plurality of nozzle side position-determining members are provided and arranged in a constant positional relationship against each of the nozzle components, and a cap side position-determining member is provided and arranged in said positional relationship with respect to each of the cap members, wherein the position of the cap members and nozzle components is determined by engaging the position-determining members.

10. The ink-jet type image forming apparatus according to claim 9, wherein the cap carriage is movable in the same direction as the direction of the movement of a recording carriage so that the cap carriage is moved by the recording head carriage.

11. The ink-jet type image forming apparatus according to claim 10, wherein the recording head carriage and cap carriage are movable in a direction toward and away from each other and the nozzle side position-determining members and the cap side position-determining member can expand or retract in the direction.

12. The ink-jet type image forming apparatus according to claim 1, wherein different suction pressures are generated by moving the piston in the cylinder.

13. The ink-jet type image forming apparatus according to claim 12, wherein the ink suction pump applies high suction pressure to the ink suction port on one side when the cylinder is moved to one side, and applies gradually increasing suction pressure to the ink suction port on the opposite side when said cylinder is moved to the opposite side.

14. The ink-jet type image forming apparatus according to claim 13, wherein the ink suction port on the one side is formed toward the center of the cylinder, and the ink suction port on the opposite side is formed toward the end portion of the cylinder.

15. The ink-jet type image forming apparatus of claim 14, wherein two suction chambers are formed by partitioning the inside of the cylinder by the piston, and the initial capacity when suction begins of each suction chamber is different.

16. An ink-jet type image forming apparatus comprising:

a recording head having a plurality of nozzle components for ejecting ink in accordance with image information;

a plurality of cap members for covering the nozzle components;

an ink suction pump connected to the cap members, the ink suction pump suctioning the ink in the cap members, the ink suction pump includes a cylinder having an interior space and two ink suction ports passing through the interior space, and a piston movably arranged in the interior space, each of the ink suction ports being connected to different cap members, and the piston being movable between the two ink suction ports; and an ink expulsion port provided between the two ink suction ports in the cylinder and an ink expulsion path that passes through ink suction chambers formed on both sides of the piston, the ink explosion port, a through-hole and a drain port, wherein the piston includes a piston head and a piston head body having the through-hole formed therethrough and the drain port formed in a side of the piston head body and the piston head slides in the cylinder, and a piston rod is attached to the piston head, and each of a pair of sealing members on the piston rod seals an opening facing each ink suction chamber of said ink expulsion path to seal one side of the opening depending on the direction of motion of the piston rod.

17. An ink suction pump for an ink-jet type image forming apparatus, comprising:

a cylinder having an interior space and two ink suction ports passing through the cylinder to the interior space;

a movable piston in the interior space, the piston including a piston head and a piston head body having a through-hole formed therethrough and a drain port formed in a side of the piston head body in communication with the through-hole;

wherein ink within cap members is suctioned by moving the piston within the cylinder.

18. An ink suction pump used in an ink-jet type image forming apparatus, comprising:

a cylinder having an interior space and two ink suction ports passing through the cylinder to said interior space; and a movable piston placed in the interior space, wherein a different suction pressure is generated in each ink suction port by moving the piston in the cylinder, the piston including a piston head and a piston head body having a through-hole formed therethrough and a drain formed in a side of the piston head body in communication with the through-hole.

* * * * *